US011041676B2

(12) United States Patent
Lee et al.

(10) Patent No.: US 11,041,676 B2
(45) Date of Patent: Jun. 22, 2021

(54) HEAT EXCHANGER

(71) Applicant: LG ELECTRONICS INC., Seoul (KR)

(72) Inventors: Eungyul Lee, Seoul (KR); Seungmo Jung, Seoul (KR); Juhyok Kim, Seoul (KR); Taegyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 131 days.

(21) Appl. No.: 15/749,471

(22) PCT Filed: Jul. 29, 2016

(86) PCT No.: PCT/KR2016/008336
§ 371 (c)(1),
(2) Date: Jan. 31, 2018

(87) PCT Pub. No.: WO2017/023027
PCT Pub. Date: Feb. 9, 2017

(65) Prior Publication Data

US 2018/0231319 A1 Aug. 16, 2018

(30) Foreign Application Priority Data

Jul. 31, 2015 (KR) ..... 10-2015-0108929
Jul. 8, 2016 (KR) ..... 10-2016-0086782
Jul. 26, 2016 (KR) ..... 10-2016-0095052

(51) Int. Cl.
*F28D 1/04* (2006.01)
*F28F 1/02* (2006.01)
(Continued)

(52) U.S. Cl.
CPC ..... *F28D 1/04* (2013.01); *F28F 1/022* (2013.01); *F28F 1/025* (2013.01); *F28F 1/128* (2013.01);
(Continued)

(58) Field of Classification Search
CPC .... F28F 1/126; F28F 1/128; F28F 1/14; F28F 1/022; F28F 1/32; F28F 1/325;
(Continued)

(56) References Cited

U.S. PATENT DOCUMENTS 8,656,986 B2 * 2/2014 Yuan ..... F28F 1/126 165/152
2011/0036550 A1 * 2/2011 Jiang ..... F28F 1/128 165/173
2011/0048688 A1 * 3/2011 Leitch ..... F28D 1/0435 165/173
2011/0139428 A1 * 6/2011 Kim ..... F28F 1/128 165/181
(Continued)

FOREIGN PATENT DOCUMENTS

JP 2007-183027 7/2007
KR 10-0765557 10/2007
(Continued)

OTHER PUBLICATIONS

International Search Report and Written Opinion (with English Translations) dated Nov. 30, 2016 issued in Application No. PCT/KR2016/008336.

*Primary Examiner* — Tho V Duong
(74) *Attorney, Agent, or Firm* — Ked & Associates LLP

(57) ABSTRACT

A heat exchanger may include flat tubes formed of a microchannel type, and first and second fins positioned at a top and bottom of the flat tubes so as to conduct the heat of the flat tubes. The first and second fins may be respectively provided with first and second condensate water discharge fins at a top and bottom. The second condensate water discharge fins of the first fins and the first condensate water discharge fins of the second fins may come into contact, and the second condensate water discharge fins of the first fins and the first condensate water discharge fins of the second fins may be disposed in a line with respect to a vertical direction, thereby having an advantage of quickly transferring condensate water formed at the top to the bottom.

7 Claims, 27 Drawing Sheets

(51) Int. Cl.

| | |
|---|---|
| ***F28F 9/013*** | (2006.01) |
| ***F28F 1/42*** | (2006.01) |
| ***F28F 17/00*** | (2006.01) |
| ***F28F 1/32*** | (2006.01) |
| ***F28F 1/12*** | (2006.01) |

(52) U.S. Cl.
CPC ..... *F28F 1/32* (2013.01); *F28F 1/42* (2013.01); *F28F 9/013* (2013.01); *F28F 17/005* (2013.01); *F28F 2260/02* (2013.01)

(58) Field of Classification Search
CPC ..... F28F 1/025; F28F 1/42; F28F 2215/08; F28F 17/005; F28F 9/013
See application file for complete search history.

(56) References Cited

U.S. PATENT DOCUMENTS

| | | | | |
|---|---|---|---|---|
| 2013/0153174 | A1* | 6/2013 | Taras | F28F 1/022 165/104.19 |
| 2013/0299153 | A1* | 11/2013 | Jindou | F28F 1/325 165/181 |
| 2015/0034289 | A1* | 2/2015 | Seo | F28F 1/12 165/173 |

FOREIGN PATENT DOCUMENTS

| | | |
|---|---|---|
| KR | 10-2011-0004042 | 1/2011 |
| KR | 10-2011-0013088 | 2/2011 |
| KR | 10-2015-0014826 | 2/2015 |
| KR | 10-1534612 | 7/2015 |

* cited by examiner

HEAT EXCHANGER

CROSS-REFERENCE TO RELATED PATENT APPLICATIONS

This application is a U.S. National Stage Application under 35 U.S.C. § 371 of PCT Application No. PCT/KR2016/008336, filed Jul. 29, 2016, which claims priority to Korean Patent Application No. 10-2015-0108929, filed Jul. 31, 2015; Korean Patent Application No. 10-2016-0086782, filed Jul. 8, 2016; and Korean Patent Application No. 10-2016-0095052, filed Jul. 26, 2016, whose entire disclosures are hereby incorporated by reference.

TECHNICAL FIELD

The present invention relates to a heat exchanger and, more particularly, to a heat exchanger capable of easily discharging condensate water when it is used as an evaporator.

BACKGROUND ART

In general, a heat exchanger may be used as a condenser or an evaporator in a cooling cycle apparatus including a compressor, a condenser, an expansion apparatus, and an evaporator.

Furthermore, the heat exchanger is disposed in a vehicle or a refrigerator and heat-exchange a refrigerant and air.

The heat exchanger may be divided into a fin tube type heat exchanger and a micro channel type heat exchanger depending on its structure.

The fin tube type heat exchanger is fabricated using a copper material, and the micro channel type heat exchanger is fabricated using an aluminum material.

The micro channel type heat exchanger has better efficiency than the fin tube type heat exchange because a fine flow channel is formed in the micro channel type heat exchanger.

The fin tube type heat exchanger is easily fabricated because a fin and a tube are welded, whereas the micro channel type heat exchanger has a disadvantage in that an initial investment cost according to fabrication is high because it is fabricated through brazing by inputting it into a furnace.

FIG. 1 is a cross-sectional view of a micro channel type heat exchanger according to a conventional technology.

The micro channel type heat exchanger according to a conventional technology includes a plurality of flat tubes 1 in which fine flow channels are formed therein, fin 2 disposed between the flat tubes 1 and connecting the flat tubes 1 to conduct heat, and headers 3 and 4 assembled with one side and the other side of the flat tubes 1.

The fins 2 are coupled to the flat tubes 1 disposed on both sides. The fins 2 are disposed in zigzags in the length direction of the flat tubes 1.

The conventional micro channel type heat exchanger fabricated as described above has very higher heat exchange efficiency of a refrigerant and air than the fin tube type heat exchanger, but has a problem in that the discharge of generated condensate water is difficult if the exchanger is used as an evaporator.

The conventional micro channel type heat exchanger has a problem in that heat efficiency of an evaporator is deteriorated because condensate water generated when the exchanger is used as the evaporator is not discharged and the generated condensate water is stagnated between the fin and frozen.

PRIOR ART DOCUMENT

Patent Document

Korean Patent No. 10-0765557

DISCLOSURE

Technical Problem

An object of the present invention is to provide a micro channel type heat exchanger capable of easily discharging condensate water.

An object of the present invention is to provide a micro channel type heat exchanger capable of being fabricated in a fin roll method.

An object of the present invention is to provide a micro channel type heat exchanger in which a fluid can easily flow in the length direction of a flat tube and a direction orthogonal to the length direction of the flat tube.

An object of the present invention is to provide a micro channel type heat exchanger having a structure in which condensate water generated from a fin disposed on the upper side can easily flow to a fin disposed on the lower side.

Objects of the present invention are not limited to the above-described objects and other objects not described above will be evidently understood by those skilled in the art from the following description.

Technical Solution

In the present invention, a heat exchanger includes a flat tube horizontally formed in a micro channel type; a first fin disposed over the flat tube to conduct heat of the flat tube; and a second fin disposed under the flat tube to conduct heat of the flat tube, wherein:

The first fin includes a first fin part disposed over the flat tube and disposed to cross the flat tube; a second fin part disposed over the flat tube, disposed to cross the flat tube and disposed to be isolated from the first fin part; a first bent part bent from the first fin part and the second fin part to connect upper parts of the first fin part and the second fin part; a second bent part bent from the first fin part and the second fin part to connect lower parts of the first fin part and the second fin part; a flow space formed between the isolated first fin part and second fin part and formed to be open back and forth; a first condensate water discharge fin forming a first condensate water discharge hole by cutting off the first bent part and upward bent from the first bent part; and a second condensate water discharge fin forming a second condensate water discharge hole by cutting off the second bent part and downward bent from the second bent part, and The second fin includes a first fin part disposed over the flat tube and disposed to cross the flat tube; a second fin part disposed over the flat tube, disposed to cross the flat tube and disposed to be isolated from the first fin part; a first bent part bent from the first fin part and the second fin part to connect upper parts of the first fin part and the second fin part; a second bent part bent from the first fin part and the second fin part to connect lower parts of the first fin part and the second fin part; a flow space formed between the isolated first fin part and second fin part and formed to be open back and forth; a first condensate water discharge fin forming a first condensate water discharge hole by cutting off the first bent part and upward bent from the first bent part; and a second condensate water discharge fin forming a second condensate water discharge hole by cutting off the second bent part and downward bent from the second bent part.

The second condensate water discharge fin of the first fin and the first condensate water discharge fin of the second fin may be disposed to come into contact with each other.

The second condensate water discharge fin of the first fin and the first condensate water discharge fin of the second fin may be disposed to be isolated from each other.

The second condensate water discharge hole may be disposed at the bottom of the flow space of the first fin.

The first condensate water discharge hole and the second condensate water discharge hole may be disposed outside the flat tube.

The first condensate water discharge fin and the first condensate water discharge hole may be formed ahead of and behind the flat tube, respectively.

The second condensate water discharge fin and the second condensate water discharge hole may be formed ahead of and behind the flat tube, respectively.

The second condensate water discharge fin forming the second condensate water discharge hole of the first fin part may be formed in a plural number, and the first condensate water discharge fin of the second fin part may be disposed to come into contact with any one of the plurality of second condensate water discharge fins.

The first condensate water discharge fin forming the first condensate water discharge hole of the second fin part may be formed in a plural number, and the second condensate water discharge fin of the first fin part may be disposed to come into contact with any one of the plurality of first condensate water discharge fins.

The second condensate water discharge fin forming the second condensate water discharge hole of the first fin part may be formed in a plural number, the first condensate water discharge fin forming the first condensate water discharge hole of the second fin part may be formed in a plural number, and the plurality of second condensate water discharge fins may be disposed to come into contact with the plurality of first condensate water discharge fins, respectively.

A connection part left over in the first bent part when the first condensate water discharge fin is formed and disposed at the edge of the first bent part to connect the first fin part and the second fin part may be further included.

A connection part left over in the second bent part when the second condensate water discharge fin is formed and disposed at the edge of the second bent part to connect the first fin part and the second fin part may be further included.

The first fin may include a unit wave including the first fin part, the first bent part, the second fin part and the second bent part, a plurality of the unit waves may be formed to extend in a length direction of the flat tube, and the unit waves may be formed in a wave form.

At least any one of the first bent part and the second bent part may be formed in an arc form.

The first fin may include a unit wave including the first fin part, the first bent part, the second fin part and the second bent part, a plurality of the unit waves may be formed to extend in a length direction of the flat tube, and the unit waves may be formed in a trapezoid form.

The first fin part and the second fin part may be slantly disposed with respect to an up and down direction, and the slope direction of the first fin part and the slope direction of the second fin part may be disposed in opposite directions.

The slope direction of the first fin part and the slope direction of the second fin part may stand face to face with respect to an up and down direction.

The first fin may include a unit wave including the first fin part, the first bent part, the second fin part and the second bent part, a plurality of the unit waves may be formed to extend in a length direction of the flat tube, and the unit waves may be formed in a parallelogram form.

Advantageous Effects

The heat exchanger of the present invention has one or more following effects.

First, the present invention has an advantage in that condensate water can be easily moved to a fin disposed on the lower side through the condensate water discharge hole and the condensate water discharge fin.

Second, the present invention has an advantage in that it can be fabricated through a machine of a fin roll method because the condensate water discharge hole and the condensate water discharge fin are formed by cutting off and bending part of the first fin part and the second fin part.

Third, the present invention has an advantage in that a fabrication cost is low because it can be fabricated through a machine of a fin roll method.

Fourth, the present invention has an advantage in that condensate water can easily move through contacted condensate water discharge fin because a condensate water discharge fin disposed on the lower side of a first fin and a condensate water discharge fin disposed on the upper side of a second fin are brought in contact with each other.

Fifth, the present invention has an advantage in that condensate water can easily move through separated condensate water discharge fins because a condensate water discharge fin disposed on the lower side of a first fin and a condensate water discharge fin disposed on the upper side of a second fin are spaced apart at a specific interval.

Sixth, the present invention has an advantage in that condensate water can be easily discharged because the condensate water discharge fin, the flow space, and the condensate water discharge hole are disposed in a row with respect to an up and down direction.

Seventh, the present invention has an advantage in that a unit wave including a first fin part, a first bent part, a second fin part and a second bent part can be formed in variously manners, such as a right-angle wave form, a curved wave form, a trapezoid form and a parallelogram form.

BEST MODE

Figure 1:
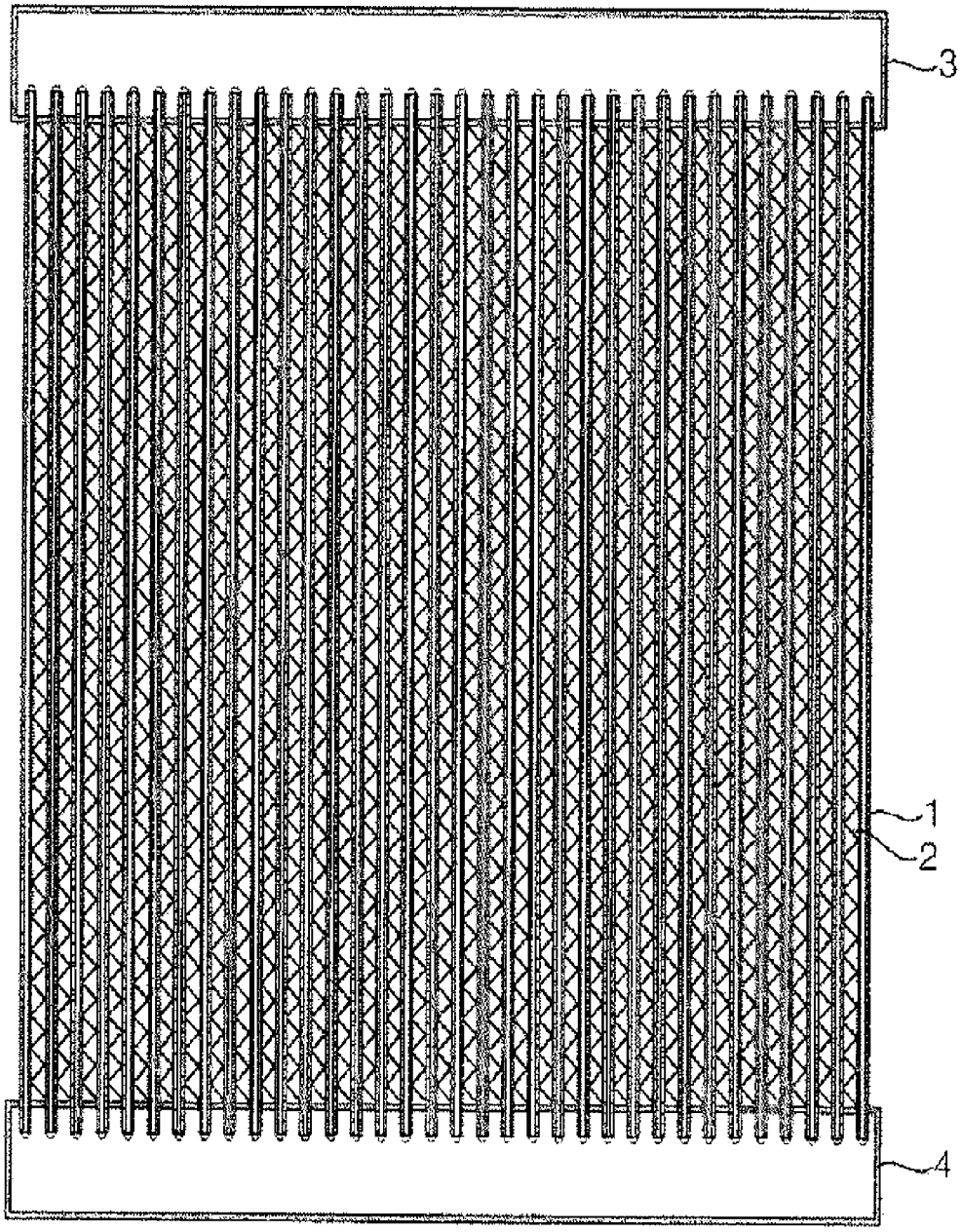
FIG. 1 is a cross-sectional view of a micro channel type heat exchanger according to a conventional technology.

Hereinafter, the present invention is described in detail with reference to the accompanying drawings.

A micro channel heat exchanger according to a first embodiment is described with reference to FIGS. 2 to 5.

The micro channel type heat exchanger according to the present embodiment includes a plurality of flat tubes 10 in which a plurality of flow channels has been formed, fins 20 disposed between two flat tubes 10 and coupled to the two flat tubes 10 to conduct heat, and a first header (not shown) and a second header (not shown) assembled with both ends of the plurality of flat tubes 10 to move a refrigerant.

In the micro channel type heat exchanger, if a refrigerant is supplied to the first header, the refrigerant passes through the flat tubes 10 and moves to the second header. In contrast, if a refrigerant is supplied to the second header, the refrigerant flows to the first header.

The first header and the second header have structures widely known to those skilled in the art, and a detailed description thereof is omitted.

The flat tube 10 is formed in a flat shape and has a plurality of flow channels formed therein. The flat tube 10 is formed using a metal material. In the present embodiment, the flat tube is formed using an aluminum material.

In the present embodiment, the flat tube 10 is horizontally disposed, and the extension direction of the fins 20 is horizontally disposed. The micro channel type heat exchanger according to the present embodiment has a structure in which the flat tubes 10 and the fins 20 are horizontally disposed to easily discharge condensate water.

Unlike in the present embodiment, the flat tube 10 and the extension direction of the fins 20 may be vertically disposed.

The fin 20 is bent in the length direction (left and right direction in the drawing) of the flat tube 10. The fin 20 has an advantage in that a fabrication cost is low because the fin can be fabricated through a consecutive process according to a fin roll method.

The fin 20 is formed using a metal material. In the present embodiment, the fin is made of the same aluminum as the flat tube 10. The fin 20 is for improving heat exchange efficiency by rapidly conducting heat of the flat tube 10.

The fins 20 are disposed between the flat tubes 10. For a description, the fin 20 at the top is defined as a first fin 20-1, a fin 20 disposed under the first fin 20-1 is defined as a second fin 20-2, and a fin 20 disposed under the second fin 20-2 is defined as a third fin 20-3.

The fin 20 includes a first fin part 30 disposed between two flat tubes 10, a first bent part 50 bent from the first fin part 30 and coming into contact with one of the two flat tubes 10, a second fin part 40 bent from the first bent part 50, disposed opposite the first fin part 30, and disposed between the two flat tubes 10, and a second bent part 60 bent from the second fin part 40 and coming into contact with one of the two flat tubes 10.

For convenience of description, the flat tube 10 coming into contact with the first bent part 50 is defined as a first flat tube 11, and the flat tube 10 coming into contact with the second bent part 60 is defined as a second flat tube 12.

The first fin 20-1 is disposed over the second flat tube 12, and the second fin 20-2 is disposed under the second flat tube 12.

In the fin 20, the first fin part 30, the first bent part 50, the second fin part 40 and the second bent part 60 are repeatedly formed.

The first fin part 30 supports the first flat tube 11 and the second flat tube 12.

The first fin part 30 is orthogonally disposed with respect to the length direction of the first flat tube 11 and the second flat tube 12.

Like the first fin part 30, the second fin part 40 supports the first flat tube 11 and the second flat tube 12 and is orthogonally disposed with respect to the length direction of the first flat tube 11 and the second flat tube 12.

The first fin part 30 and the second fin part 40 are spaced apart at a specific distance. A flow space 25 in which air flows is formed between the first fin part 30 and the second fin part 40. Air for heat exchange passes through the flow space 25 formed between the first fin part 30 and the second fin part 40.

In the present embodiment, air flows from the front side to the rear side. The flow space 25 is formed from the front side to the rear side.

The flow space 25 formed between the first fin part 30 and the second fin part 40 is horizontally open. Any one of the top and bottom of the flow space 25 is open to the bent part, and the other thereof is closed by the flat tube.

As the interval between the flow spaces 25 formed between the first fin part 30 and the second fin part 40 is narrower, more fin parts can be disposed. Accordingly, heat exchange efficiency can be improved.

In this case, if the interval between the flow spaces 25 is narrow, condensate water generated when the heat exchanger operates as an evaporator can be attached and fixed to the first fin part 30 and the second fin part 40 by surface tension. In the present embodiment, the interval is formed so that condensate water does not connect the first fin part 30 and the second fin part 40 by surface tension.

Condensate water generated from the first fin part 30 and the second fin part 40 downward flows because it comes into contact with air that flows along the flow space 25.

Vents 21 and 22 communicating with a neighbor flow space 25' are formed in at least any one of the first fin part 30 and the second fin part 40.

In the present embodiment, the vents 21 and 22 are formed in both the first fin part 30 and the second fin part 40. Furthermore, the two vents 21 and 22 are formed in the first fin part 30 and the second fin part 40. Unlike in the present embodiment, only one vent may be formed in the first fin part 30 and the second fin part 40.

For convenience of description, the vents 21 and 22 are defined as a first vent 21 and a second vent 22.

The vents 21 and 22 may be formed in a hole or slit form.

In the present embodiment, the vents 21 and 22 are formed by cutting off the first fin part 30 and the second fin part 40.

A (1-1)-th louver 31 that forms the first vent 21 is formed in the first fin part 30. Furthermore, a (1-2)-th louver 32 that forms the second vent 22 is formed in the first fin part 30.

The cut first fin part 30 is bent to form the (1-1)-th louver 31. The first vent 21 is formed at the position where the (1-1)-th louver 31 has been cut off.

The (1-2)-th louver 32 is also formed using the same method as the (1-1)-th louver 31.

The louvers 31 and 32 function to guide some of air, flowing along the flow space 25, to a neighbor flow space 25'.

In the present embodiment, the (1-1)-th louver 31 and the (1-2)-th louver 32 are formed to guide air in different directions.

For example, if the (1-1)-th louver 31 has been formed to guide air from a neighbor flow space 25' to the flow space 25, the (1-2)-th louver 32 is formed to guide air from the flow space 25 to the neighbor flow space 25'.

The louver is protruded from the first fin part 30 or the second fin part 40 to the flow space 25 or a neighbor flow space 25'.

The louver is vertically formed with respect to the length direction of the first flat tube 11 and the second flat tube 12.

A louver formed in the second fin part 40 has the same structure as a louver formed in the first fin part 30, which are defined as a (2-1)-th louver 41 and a (2-2)-th louver 42, for convenience of description.

The first vent 21 is formed in the second fin part 40 by the (2-1)-th louver 41, and the second vent 22 is formed by the (2-2)-th louver 42.

Since the (1-1)-th louver 31 and the (1-2)-th louver 32 are formed in opposite directions, the direction in which the fin 20 is installed when the heat exchanger is installed may not be considered.

The first bent part 50 is closely attached to the first flat tube 11 and conducts heat of the first flat tube 11.

In the present embodiment, the first bent part 50 is formed in a plane form.

In the present embodiment, the first bent part 50 is disposed on the upper side and the second bent part 60 is disposed on the lower side. However, the second bent part 60 may be disposed on the upper side and the first bent part 50 may be disposed on the lower side.

The vents and the louver are also shaped by a consecutive process by a fabrication method of a fin roll method.

Condensate water discharge fins 70 and 71 for discharging the condensate water of the flow space 25 are formed in the first bent part 50. The condensate water discharge fin 70 is cut off from the first bent part 50 and then bent and formed.

A condensate water discharge hole 51 is formed at the position where the condensate water discharge fin 70 was placed in the first bent part 50. The condensate water discharge hole formed in the first bent part 50 is defined as the first condensate water discharge hole 51.

The condensate water discharge hole 51 is disposed in the first bent part 50, but is located outside the flat tube 10. The condensate water discharge hole 51 is not covered by the flat tube 10.

In the present embodiment, two condensate water discharge fin 70 are formed in the first bent part 50 so that they face each other. Only one condensate water discharge hole 51 is formed. Unlike in the present embodiment, the condensate water discharge holes 51 may be formed ahead of and behind the flat tube 10.

Since the two condensate water discharge fins 70 are formed in a limited area, the condensate water discharge fin 70 is fabricated to have a length that is half or less of the width of the first bent part 50.

Furthermore, a connection part 52 connecting the first fin part 30 and the second fin part 40 is formed at the edge of the first bent part 50.

The connection part 52 is a part left over when the condensate water discharge fin 70 is formed. Accordingly, the connection part 52 is formed to come into contact with the condensate water discharge hole 51. The connection part 52 connects the first fin part 30 and the second fin part 40, thus improving strength of the fin 20.

Condensate water located in the flow space 25 can be discharged to the outside of the flow space 25 through the condensate water discharge hole 51.

The condensate water discharge fin 70 guides a flow of the condensate water when the condensate water is discharged. The flow space 25 of another fin is disposed under the condensate water discharge fin 70, and condensate water flows into the flow space of another fin.

The condensate water discharge hole 61 and the condensate water discharge fins 70 and 72 having the same structure as that of the first bent part 50 are also formed in the second bent part 60. A condensate water discharge hole formed in the second bent part 60 is defined as a second condensate water discharge hole 61.

Since the flat tubes 10 are stacked and the fin 20 is disposed between the flat tubes 10, a condensate water discharge fin 71 formed in the first bent part 50 and a condensate water discharge fin 72 formed in the second bent part 60 are disposed up and down.

For convenience of description, a condensate water discharge fin disposed in the first bent part 50 is defined as the first condensate water discharge fin 71, and a condensate water discharge fin disposed in the second bent part 60 is defined as the second condensate water discharge fin 72.

The first condensate water discharge fin 71 and the second condensate water discharge fin 72 may be disposed up and down. The first condensate water discharge fin 71 and the second condensate water discharge fin 72 formed in a single fin 20 are disposed up and down, but are not vertically disposed. Since the first bent part 50 and the second bent part 60 are arranged in a single fin 20 in the length direction, the first condensate water discharge fin 71 and the second condensate water discharge fin 72 are also arranged in the length direction (left and right direction in the drawing).

The first condensate water discharge fin 71 of the first fin 20-1 and the second fin 20-2 may be arranged in a row with respect to the up and down direction of the first condensate water discharge fin 71. Furthermore, the second condensate water discharge fin 72 of the first fin 20-1 and the second fin 20-2 may be arranged in a row with respect to the up and down direction of the second condensate water discharge fin 72.

In the present embodiment, the second bent part 60 of the second fin 20-2 is disposed under the first bent part 50 of the first fin 20-1.

Figure 2:
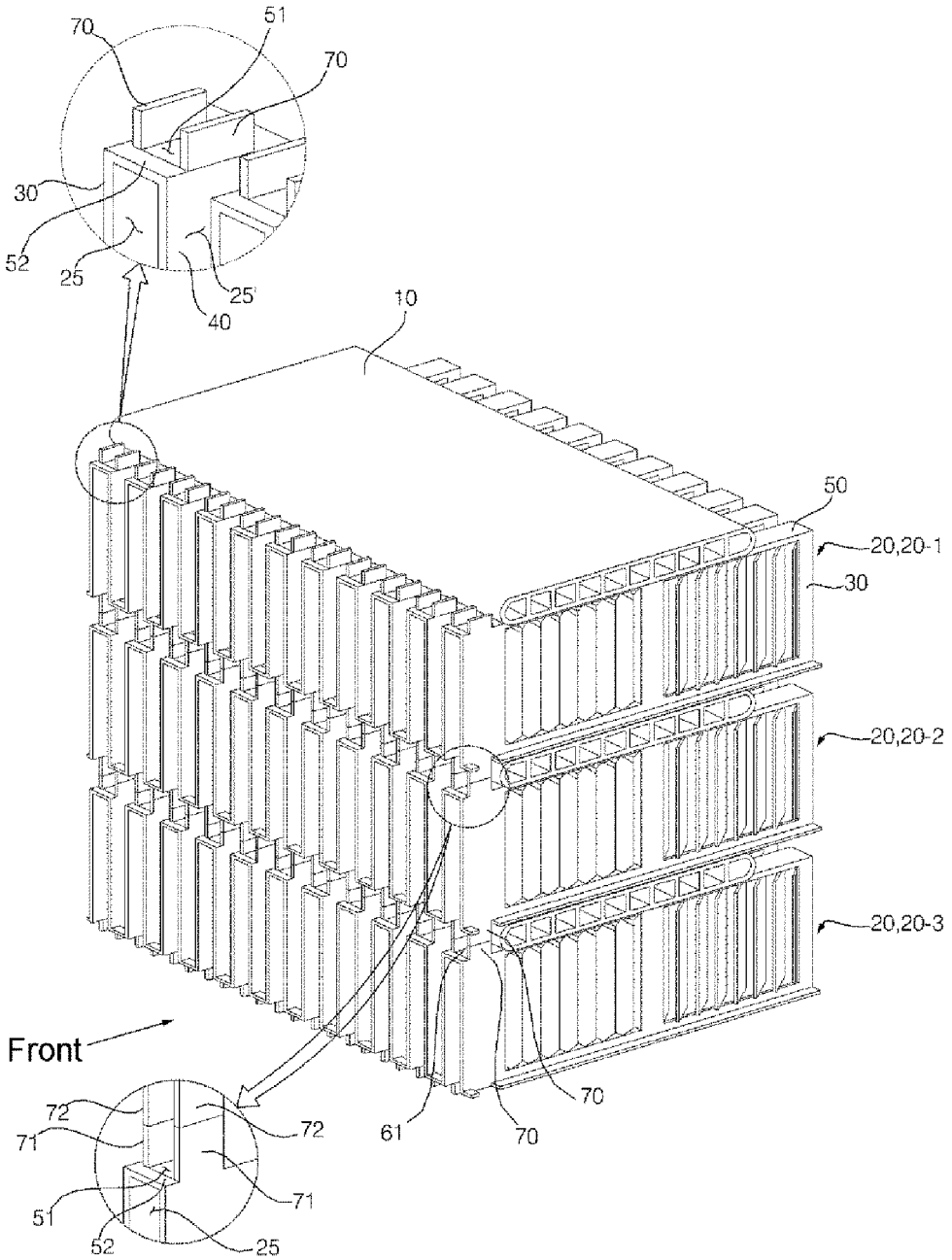
FIG. 2 is a perspective view of a micro channel type heat exchanger according to the first embodiment of the present invention.
Figure 3:
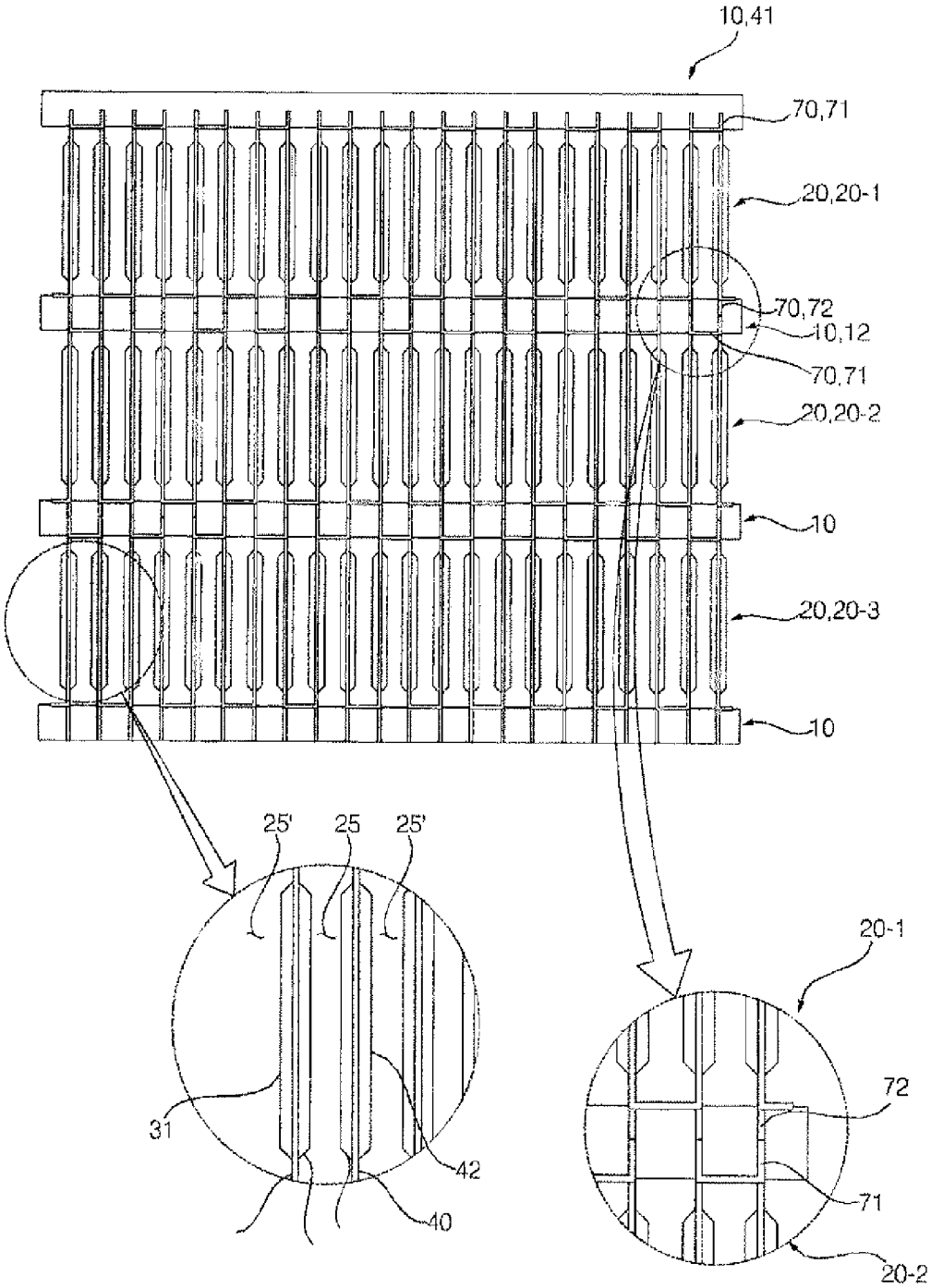
FIG. 3 is a front view of FIG. 2.
Figure 4:
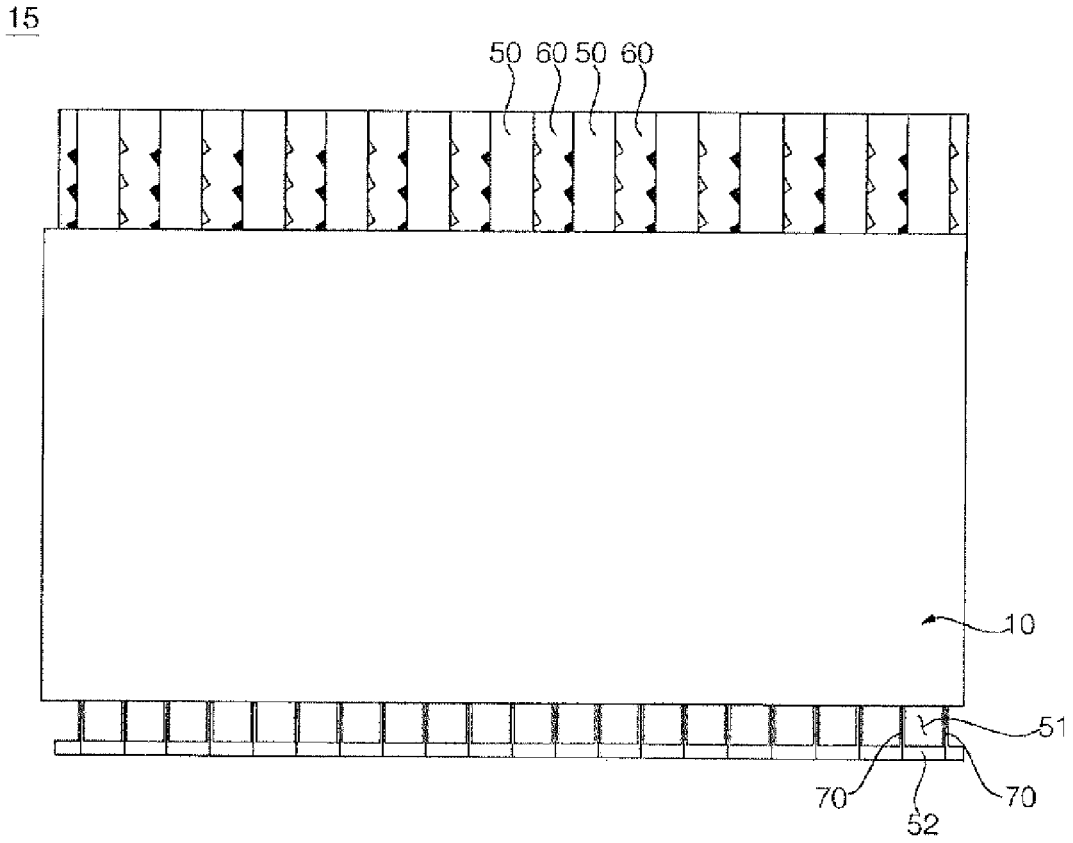
FIG. 4 is a plane view of FIG. 2.
Figure 5:
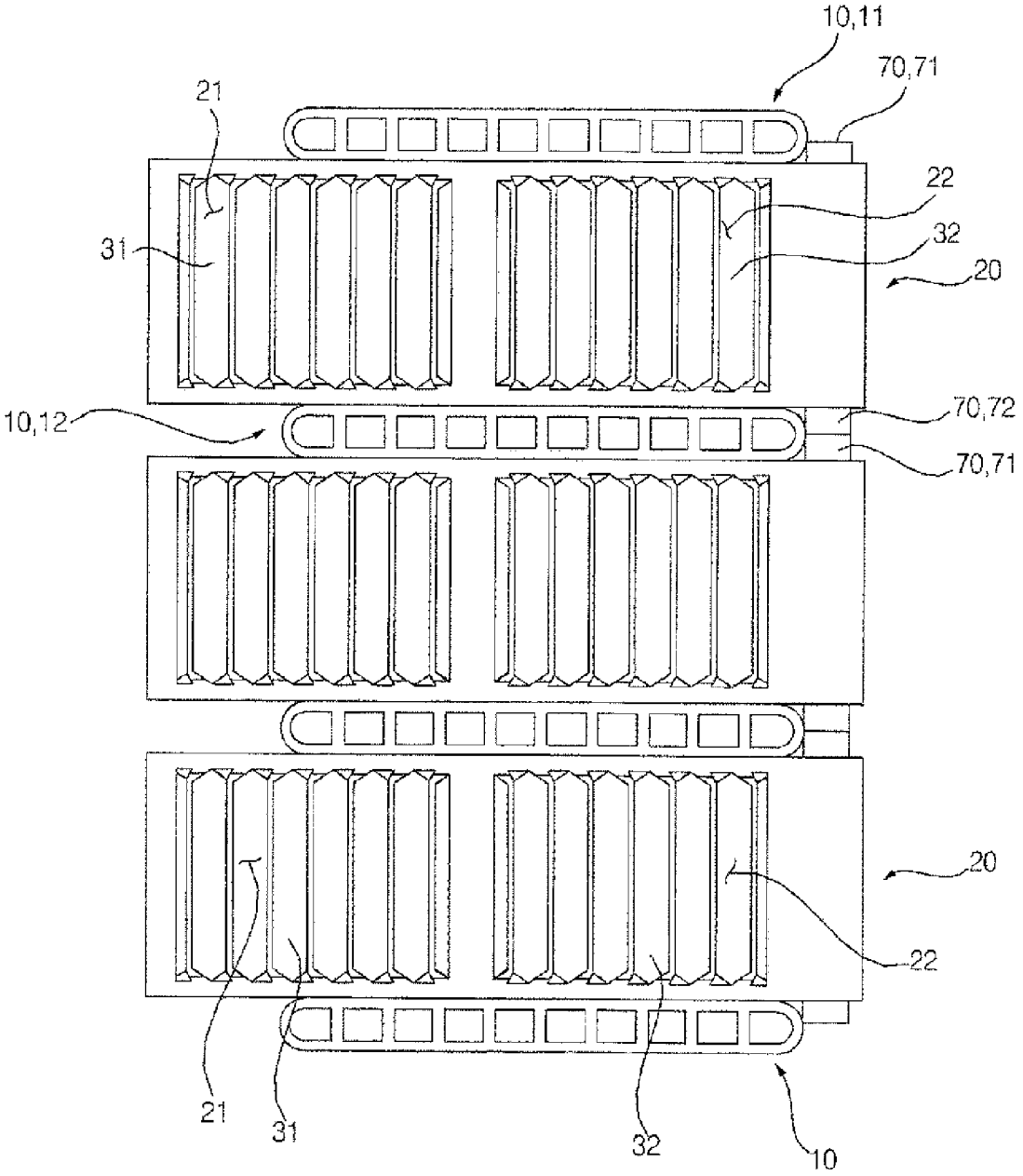
FIG. 5 is a left side view of FIG. 2.
Figure 6:
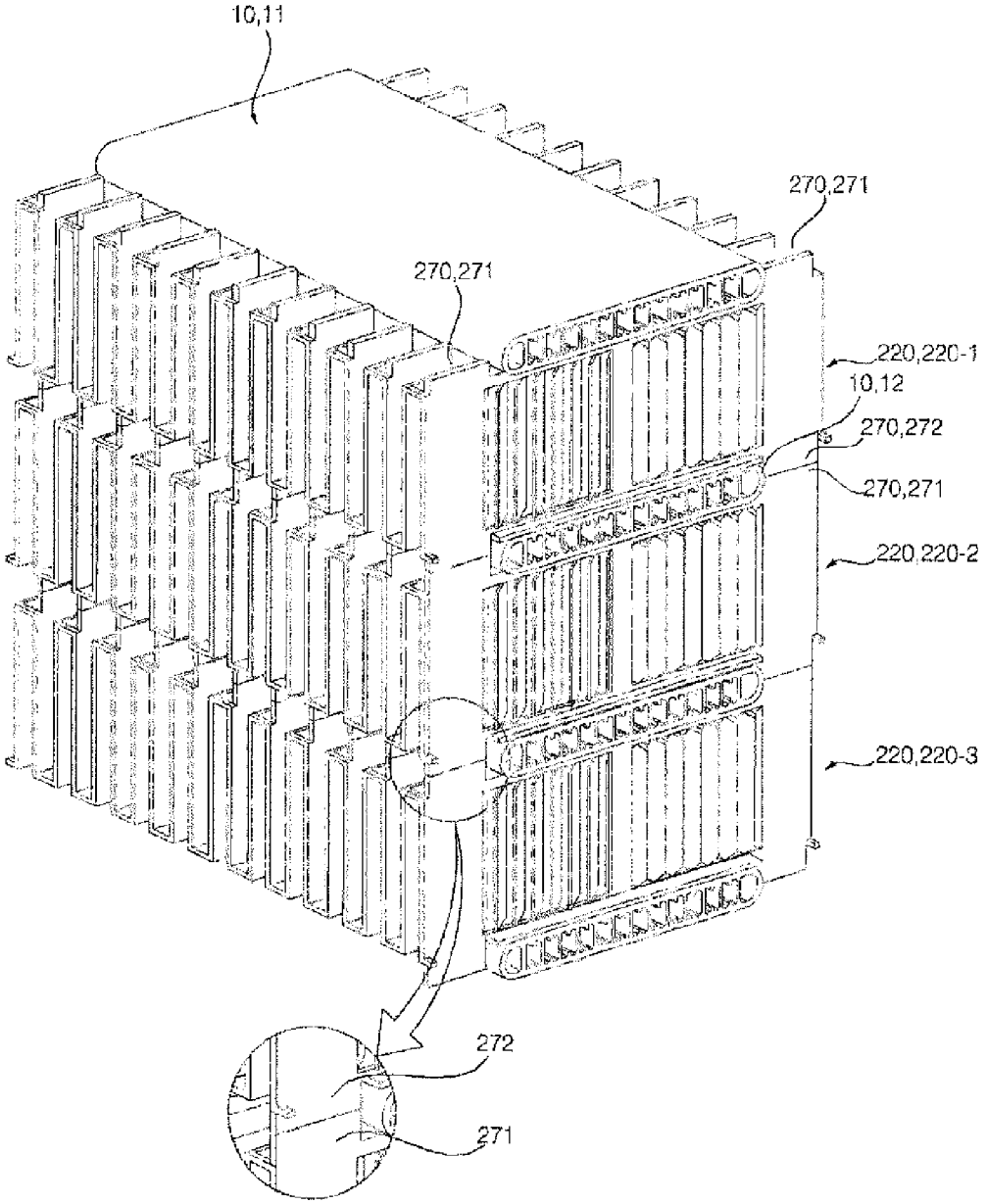
FIG. 6 is a perspective view of a micro channel type heat exchanger according to the second embodiment of the present invention.
Figure 7:
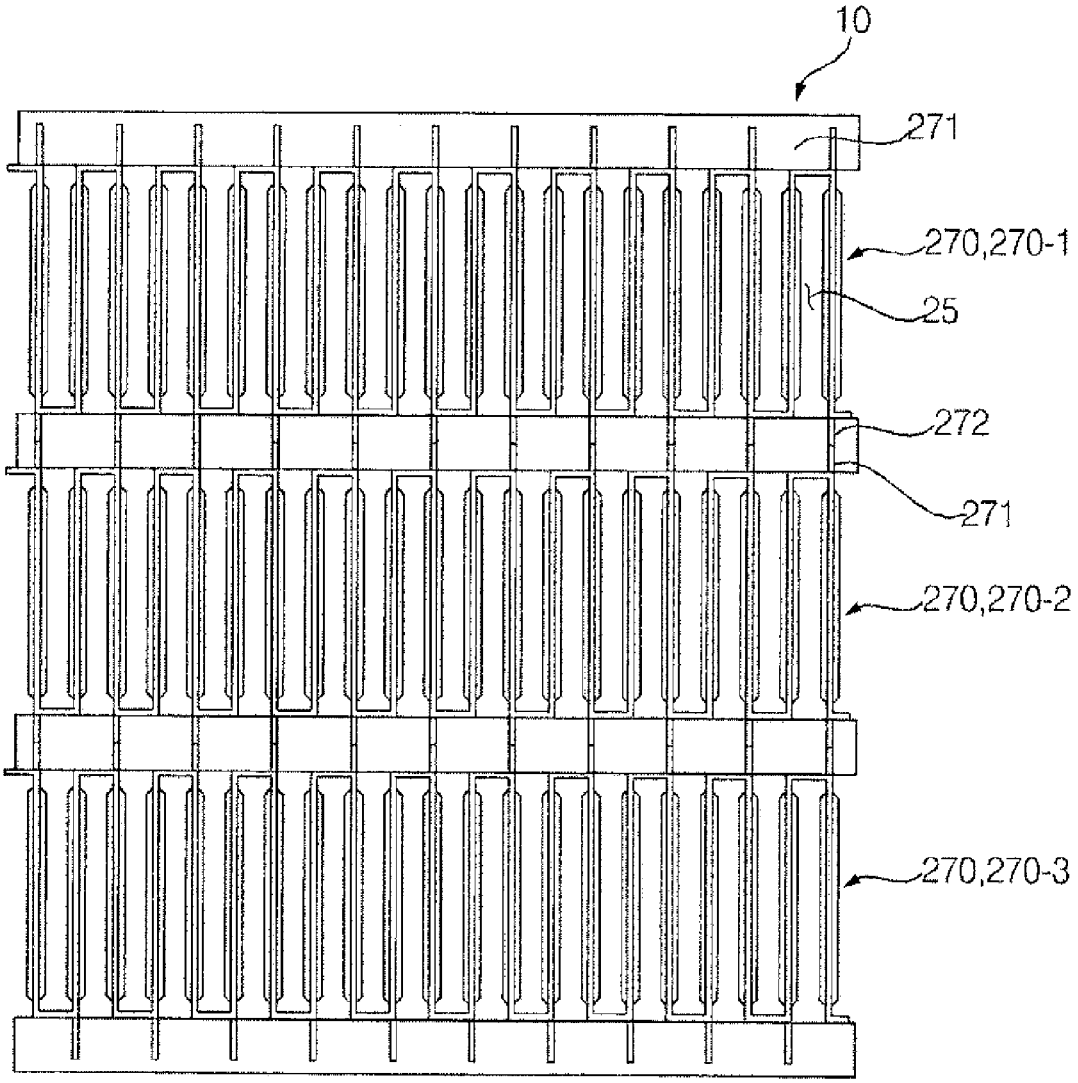
FIG. 7 is a front view of FIG. 6.
Figure 8:
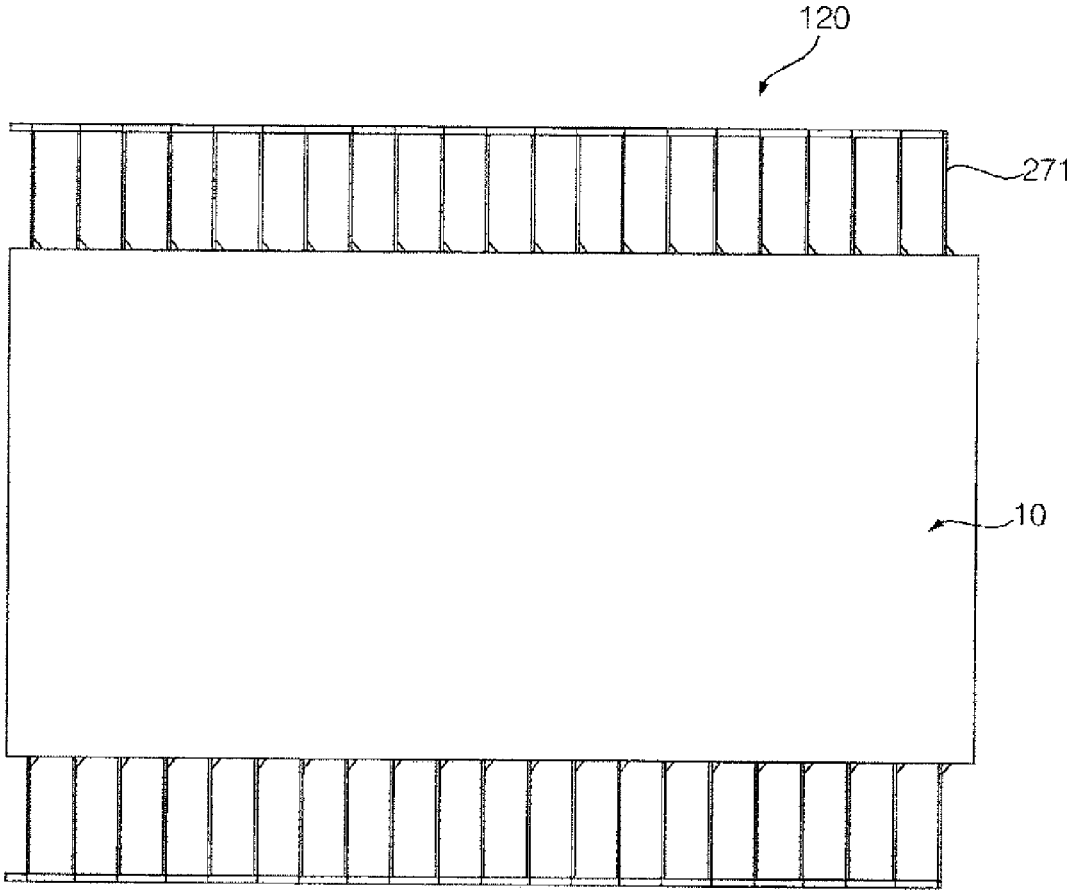
FIG. 8 is a plane view of FIG. 6.
Figure 9:
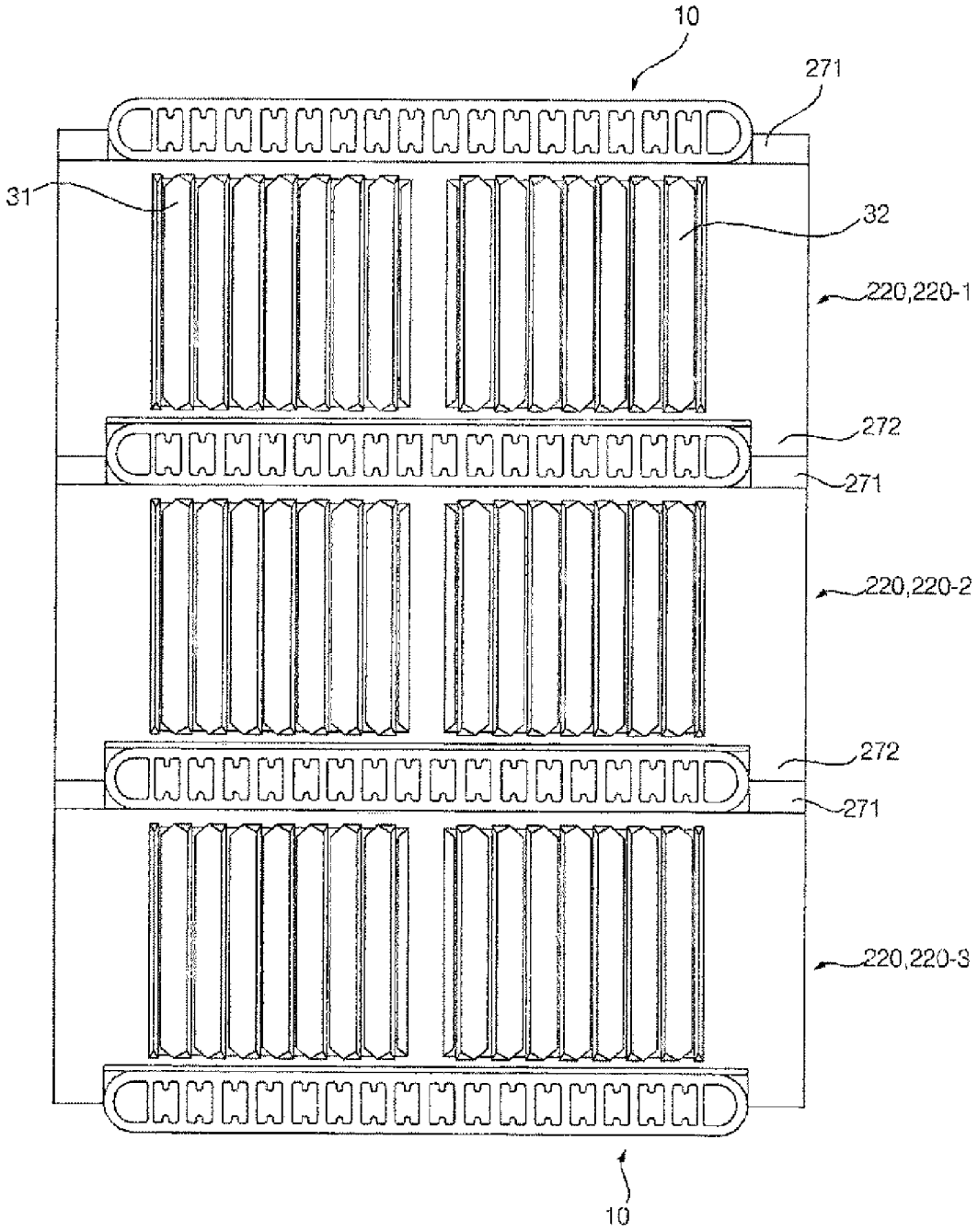
FIG. 9 is a right side view of FIG. 6.

Referring to FIG. 2, the first condensate water discharge fin 71 of the second fin 20-2 and the second condensate water discharge fin 72 of the first fin 20-1 may be arranged in a row with respect to the up and down direction.

The first condensate water discharge fin 71 of the second fin 20-2 and the second condensate water discharge fin 72 of the first fin 20-1 may come into contact with each other.

Furthermore, the first condensate water discharge fin 71 of the second fin 20-2 and the second condensate water discharge fin 72 of the first fin 20-1 may be spaced apart at a specific interval. The specific interval between the first condensate water discharge fin 71 and the second condensate water discharge fin 72 is a distance in which they can be moved by surface tension of condensate water.

In the present embodiment, the first condensate water discharge fin 71 of the second fin 20-2 and the second condensate water discharge fin 72 of the first fin 20-1 come into contact with each other in the up and down direction.

Accordingly, condensate water that has run down to the second condensate water discharge fin 72 of the first fin 20-1 may flow to the second fin 20-2 along the first condensate water discharge fin 71 of the second fin 20-2.

The edge of the flat tube 10 may be closely attached to the condensate water discharge fin 70 and disposed. When the heat exchanger is used as an evaporator, the flat tube 10 has the lowest temperature. Condensate water generated by the flat tube 10 can rapidly move downward through the closely attached condensate water discharge fin 70. If condensate water rapidly moves as described above, the freezing of the condensate water on a surface of the flat tube 10 can be minimized.

In the present embodiment, the condensate water discharge fin 70 and the condensate water discharge holes 51 and 61 are formed only on one side (front side) of the fin 20. Unlike in the present embodiment, all of the condensate water discharge fin 70 and the condensate water discharge holes 51 and 61 may be formed on both sides (front side and rear side) of the fin 20.

Furthermore, in the present embodiment, the condensate water discharge fin 70 and the condensate water discharge holes 51 and 61 are formed by cutting the first bent part 50 and the second bent part 60. Unlike in the present embodiment, however, only the condensate water discharge holes 51 and 61 may be formed. Furthermore, if only the condensate water discharge holes 51 and 61 are formed, a plurality of the condensate water discharge holes 51 and 61 may be formed along the first bent part 50 or the second bent part 60.

A micro channel type heat exchanger according to a second embodiment of the present invention is described with reference to FIGS. 6 to 9.

For a description, a fin 220 located at the top is defined as a first fin 220-1, a fin 220 located under the first fin 220-1 is defined as a second fin 220-2, and a fin 220 located under the second fin 220-2 is defined as a third fin 220-3.

Unlike in the first embodiment, in the fin 220 according to the present embodiment, condensate water discharge fins 271 and 272 are disposed on the front side and rear side of the flat tube 10, respectively.

The first condensate water discharge fins 271 are disposed on the front side and rear side of the flat tube 10, respectively. The first condensate water discharge fins 271 are disposed on the front side and rear side of the first bent part 50, respectively.

The second condensate water discharge fins 272 are disposed on the front side and rear side of the flat tube 10, respectively. The second condensate water discharge fins 272 are disposed on the front side and rear side of the second bent part 60, respectively.

The first condensate water discharge fin 271 and the second condensate water discharge fin 272 disposed in the respective fin 220 are disposed in a row with respect to the up and down direction. The first condensate water discharge fin 271 and the second condensate water discharge fin 272 disposed in different fins 220 are also disposed in a row with respect to the up and down direction.

The first condensate water discharge fin 271 and the second condensate water discharge fin 272 may be disposed in a row with the first fin part 30 or the second fin part 40. In the present embodiment, the first condensate water discharge fin 271 and the second condensate water discharge fin 272 are disposed in a row with the first fin part 30 and disposed on the same vertical plane.

If the first condensate water discharge fin 271 and the second condensate water discharge fin 272 are disposed in a row on the same vertical plane, condensate water can move in the shortest distance. Furthermore, since a bend is not formed on the path along which condensate water moves, there is an advantage in that resistance can be minimized.

In the present embodiment, first condensate water discharge holes 51 are formed on the front side and rear side of the first bent part 50, respectively. In the present embodiment, second condensate water discharge holes 61 are formed on the front side and rear side of the second bent part 60, respectively.

The first condensate water discharge holes 51 are disposed on the front side and rear side of the flat tube 10, respectively. The second condensate water discharge holes 61 are disposed on the front side and rear side of the flat tube 10, respectively.

In the present embodiment, the first condensate water discharge hole 51 is formed by only a single first condensate water discharge fin 271. In the present embodiment, the second condensate water discharge hole 61 is formed by a single second condensate water discharge fin 272.

Hereinafter, the remaining configuration is the same as that of the first embodiment, and a detailed description thereof is omitted.

Figure 10:
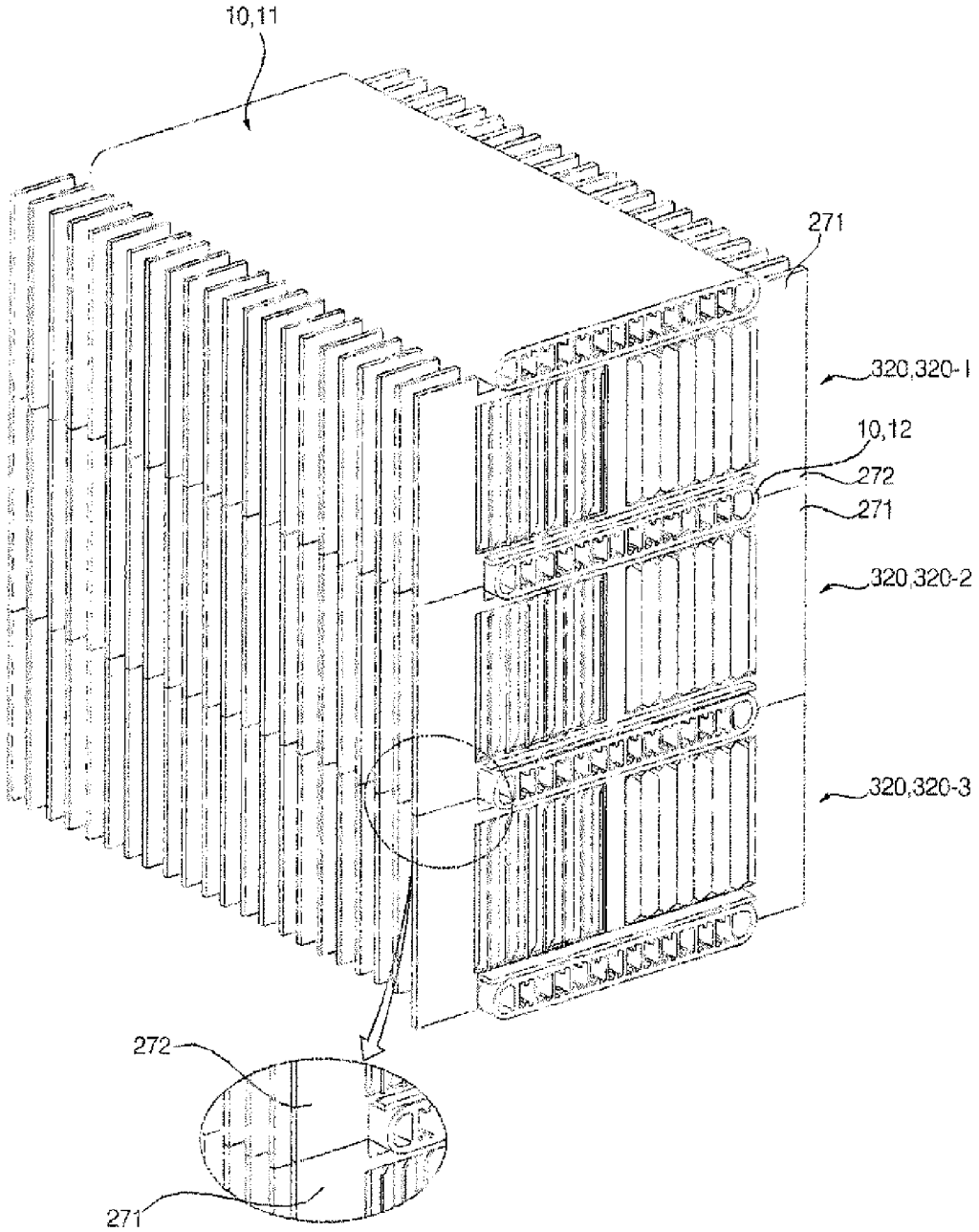
FIG. 10 is a perspective view of a micro channel type heat exchanger according to a third embodiment of the present invention.
Figure 11:
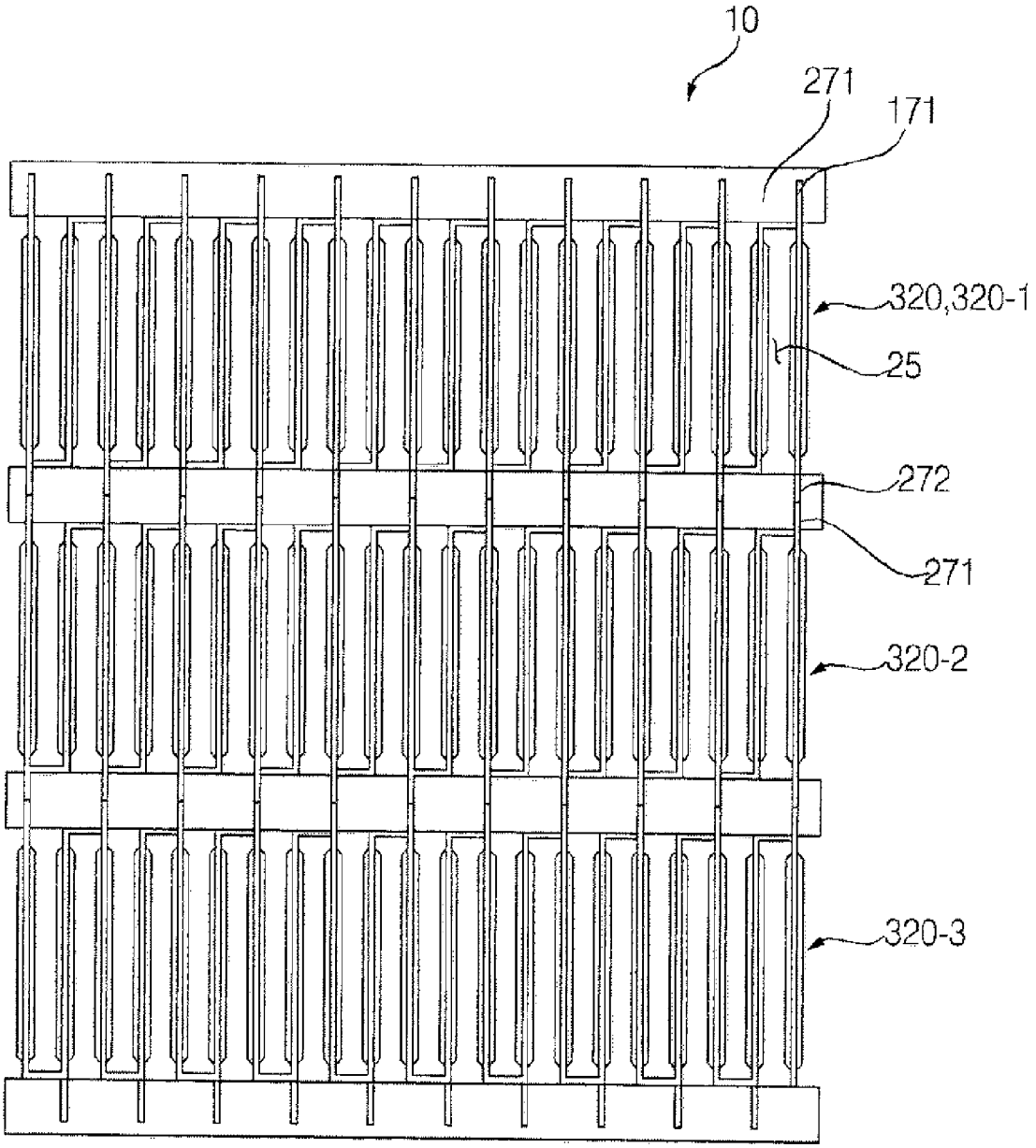
FIG. 11 is a front view of FIG. 10.
Figure 12:
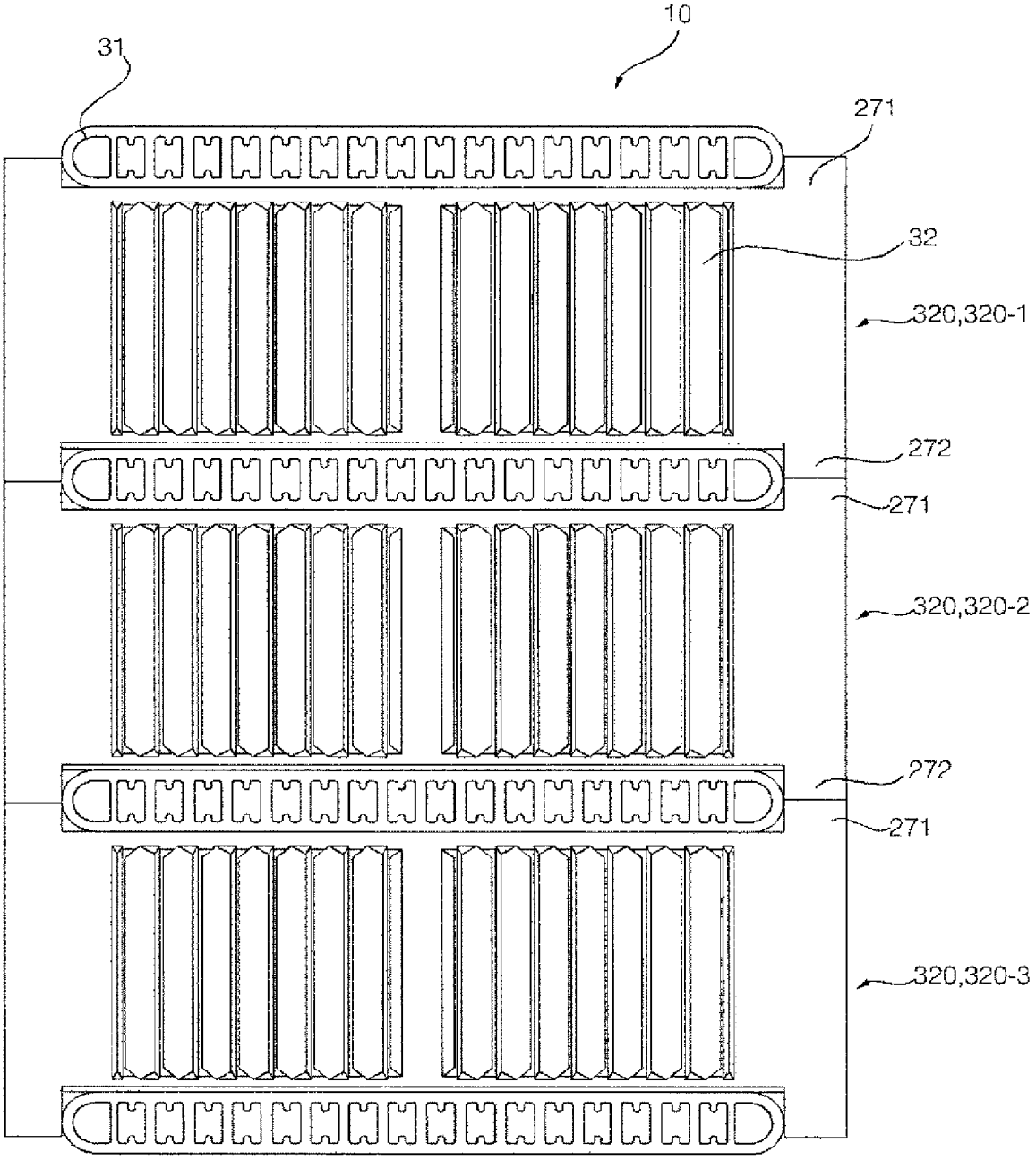
FIG. 12 is a right side view of FIG. 10.

A micro channel type heat exchanger according to a third embodiment of the present invention is described with reference to FIGS. 10 to 12.

In the present embodiment, for a description, a fin 320 located at the top is defined as a first fin 320-1, a fin 320 located under the first fin 320-1 is defined as a second fin 320-2, and a fin 320 located under the second fin 320-2 is defined as a third fin 320-3.

Unlike in the second embodiment, the fin 320 according to the present embodiment does not include the configuration of the connection part 52 forming the condensate water discharge hole.

Accordingly, the first condensate water discharge hole 51 is formed on the front side of the first bent part 50, and the front side of the first condensate water discharge hole 51 is open. The first condensate water discharge hole 51 is formed at the rear end of the first bent part 50, and the rear side of the first condensate water discharge hole 51 is open. If the connection part 52 is not present, resistance with air can be reduced. Furthermore, if the connection part 52 is not present, the forming of condensate water on the connection part 52 can be minimized.

Hereinafter, the remaining configuration is the same as that of the second embodiment, and a detailed description thereof is omitted.

Figure 13:
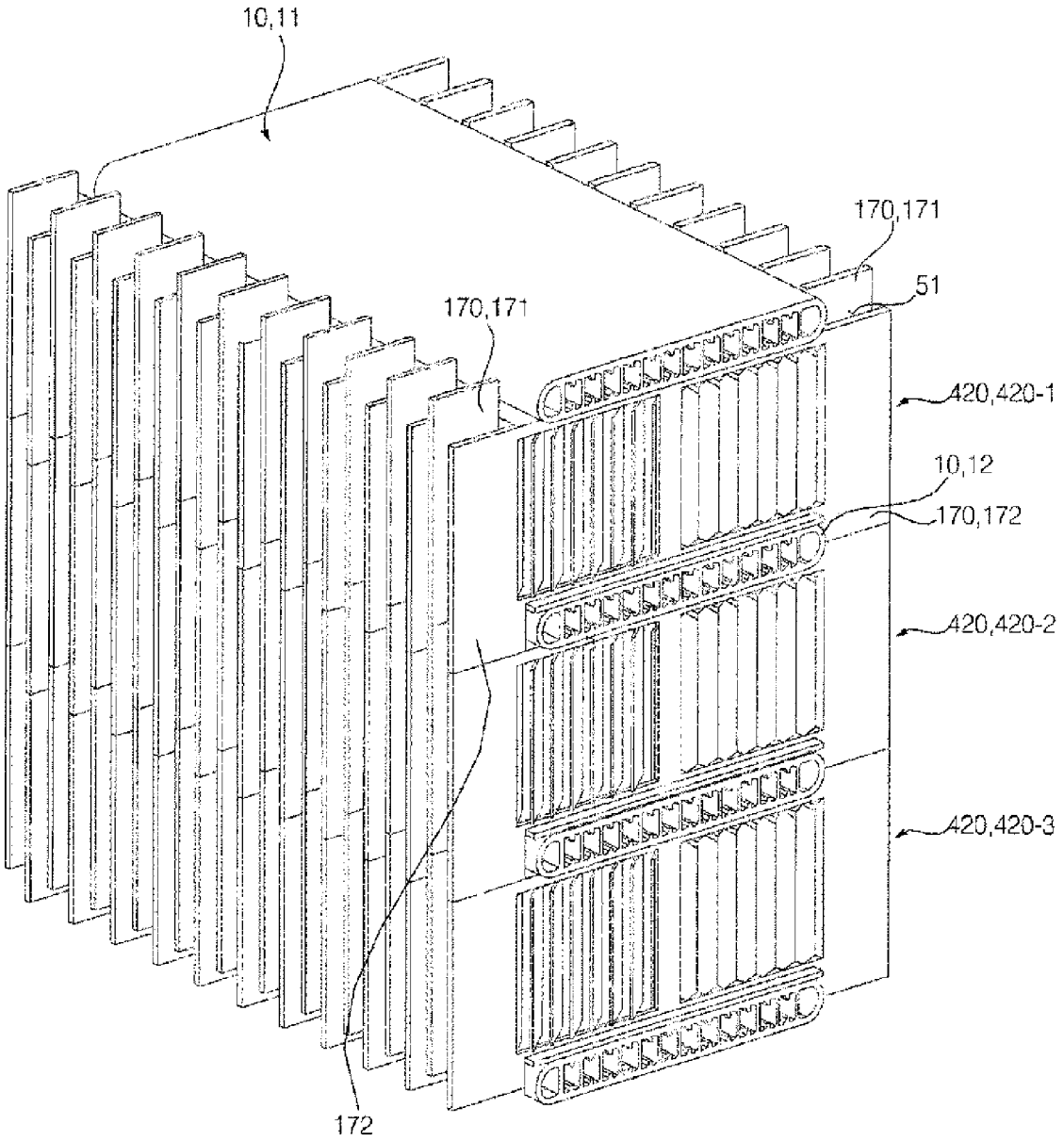
FIG. 13 is a perspective view of a micro channel type heat exchanger according to a fourth embodiment of the present invention.

A micro channel type heat exchanger according to a fourth embodiment of the present invention is described with reference to FIG. 13.

In the present embodiment, for a description, a fin 420 located at the top is defined as a first fin 420-1, a fin 420 located under the first fin 420-1 is defined as a second fin 420-2, and a fin 420 located under the second fin 420-2 is defined as a third fin 420-3.

The fin 420 according to the present embodiment is different from that of the second embodiment in the arrangement of the condensate water discharge fins 171 and 172 and the shapes of the condensate water discharge holes 51 and 61.

The first condensate water discharge fin 171 is disposed in a row with the first fin part 30, and the second condensate water discharge fin 172 is disposed in a row with the second fin part 40.

The first condensate water discharge fin 171 comes into contact with the second bent part 60. Unlike in the present embodiment, the first condensate water discharge fin 171 may come into contact with the second fin part 40.

The second condensate water discharge fin 172 comes into contact with the first bent part 50. Unlike in the present embodiment, the second condensate water discharge fin 172 may come into contact with the first fin part 30.

The first condensate water discharge fin 171 and the second condensate water discharge fin 172 are disposed to face each other.

The configuration of the connection part 52 forming the first condensate water discharge hole 51 in the second embodiment is removed. The configuration of the connection part 52 forming the second condensate water discharge hole 61 in the second embodiment is deleted.

Accordingly, the outside of the first condensate water discharge hole 51 and the outside of the second condensate water discharge hole 61 are open.

Accordingly, the first condensate water discharge hole 51 is formed on the front side of the first bent part 50, and the front side of the first condensate water discharge hole 51 is open. The first condensate water discharge hole 51 is formed at the rear end of the first bent part 50, and the rear side of the first condensate water discharge hole 51 is open. If the connection part 52 is not present, resistance with air can be reduced. Furthermore, if the connection part 52 is not present, the forming of condensate water on the connection part 52 can be minimized.

Hereinafter, the remaining configuration is the same as that of the second embodiment, and a detailed description thereof is omitted.

Figure 14:
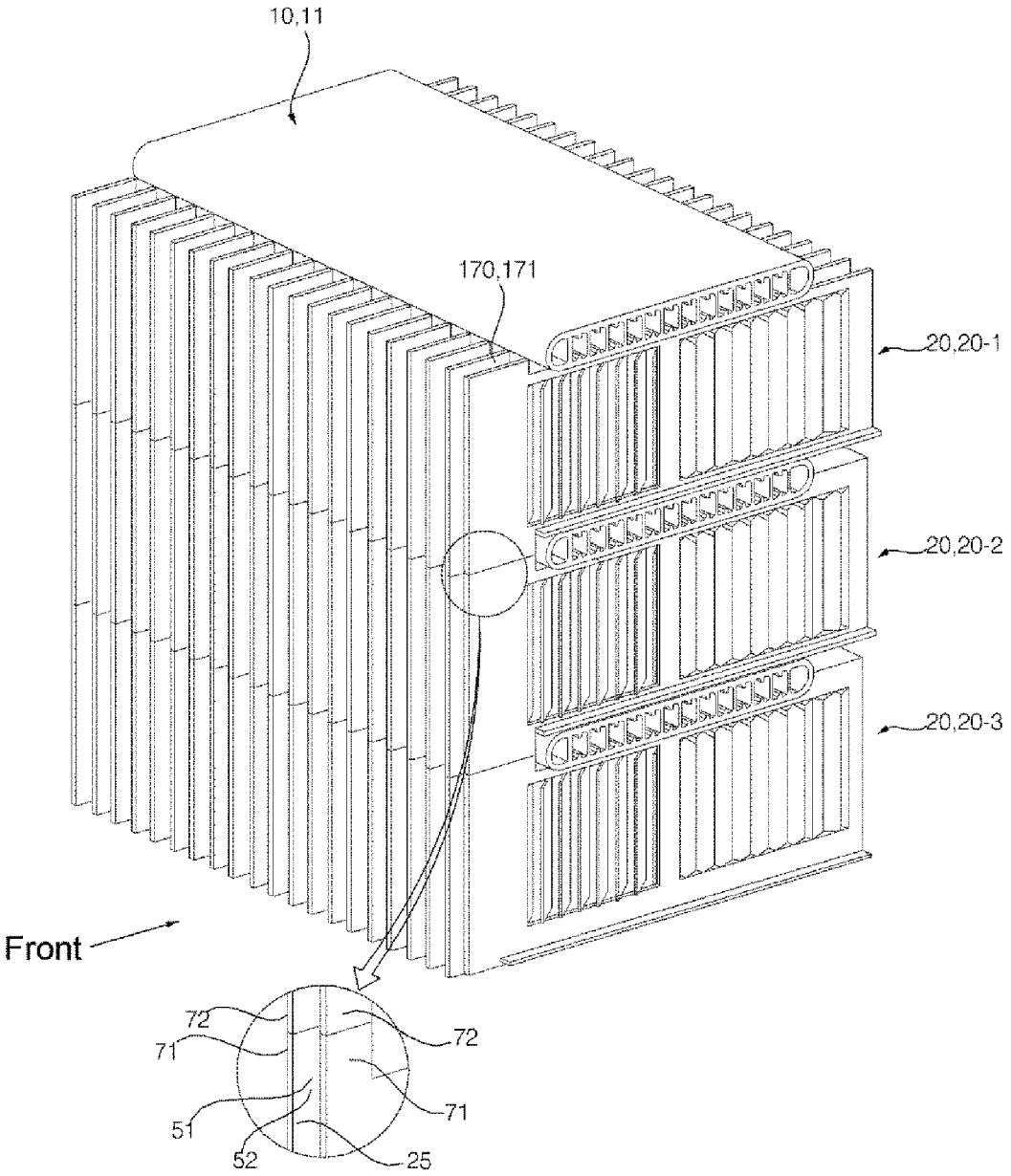
FIG. 14 is a perspective view of a micro channel type heat exchanger according to a fifth embodiment of the present invention.

A micro channel type heat exchanger according to a fifth embodiment of the present invention is described with reference to FIG. 14.

Unlike in the first embodiment, in a fin according to the present embodiment, the configuration of the connection part 52 forming the first condensate water discharge hole 51 is removed, and the configuration of the connection part 52 forming the second condensate water discharge hole 61 is also removed.

The outside of the first condensate water discharge hole 51 and the outside of the second condensate water discharge hole 61 are open.

Accordingly, the first condensate water discharge hole 51 is formed on the front side of the first bent part 50, and the front side of the first condensate water discharge hole 51 is open. The first condensate water discharge hole 51 is formed at the rear end of the first bent part 50, and the rear side of the first condensate water discharge hole 51 is open. If the connection part 52 is not present, resistance with air can be reduced. Furthermore, if the connection part 52 is not present, the forming of condensate water on the connection part 52 can be minimized.

Hereinafter, the remaining configuration is the same as that of the first embodiment, and a detailed description thereof is omitted.

Figure 15:
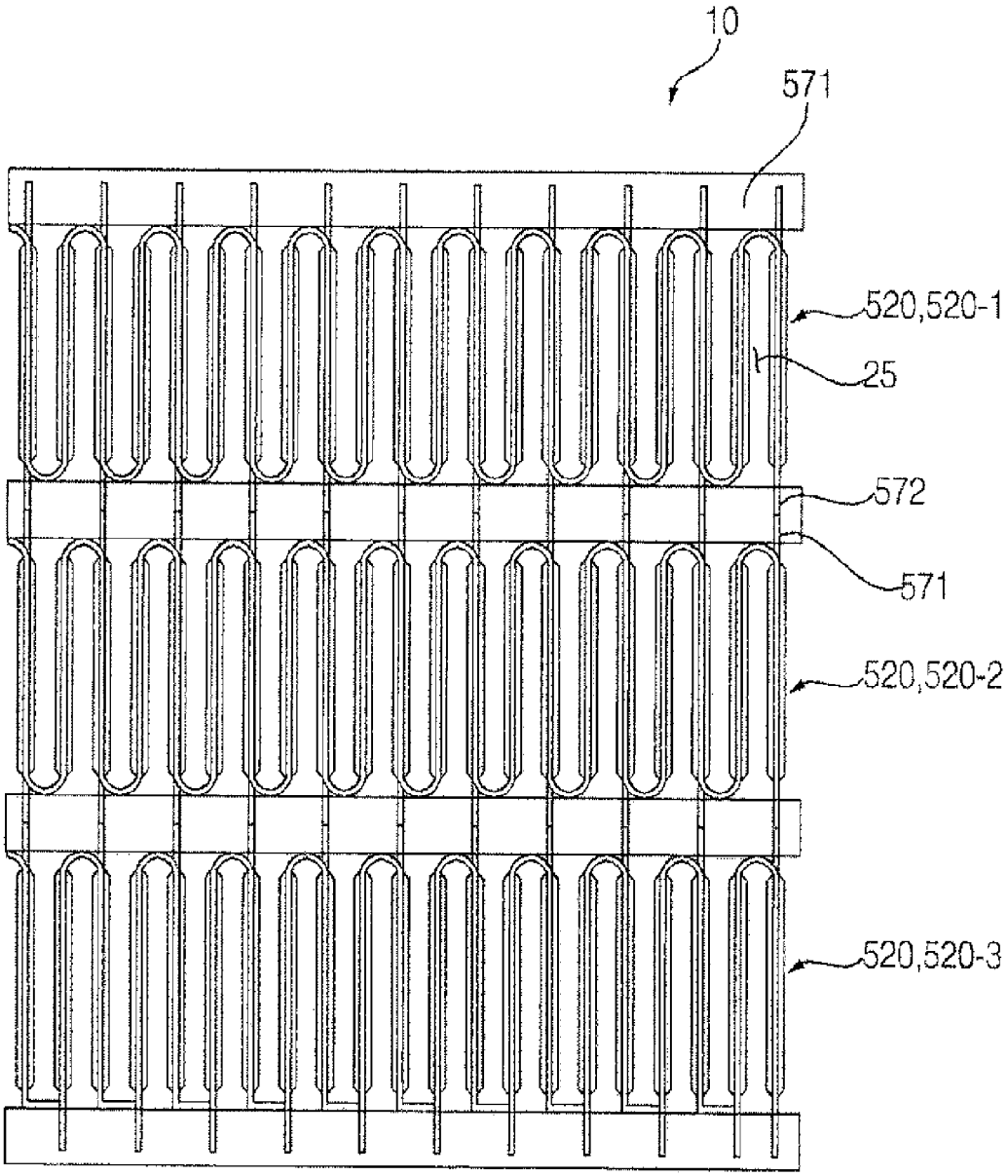
FIG. 15 is a perspective view of a micro channel type heat exchanger according to a sixth embodiment of the present invention.

A micro channel type heat exchanger according to a sixth embodiment of the present invention is described with reference to FIG. 15.

In the present embodiment, for a description, a fin 520 located at the top is defined as a first fin 520-1, a fin 520 located under the first fin 520-1 is defined as a second fin 520-2, and a fin 520 located under the second fin 520-2 is defined as a third fin 520-3.

The fin 520 according to the present embodiment has a wave form different from the shape of the second embodiment.

In the second embodiment, a unit wave formed by the first fin part 30, the first bent part 50, the second fin part 40 and the second bent part 60 is a square. In contrast, the unit wave of the present embodiment is formed in a wave form.

The first fin part 30, the first bent part 50, the second fin part 40 and the second bent part 60 may be formed in a curve form.

The first bent part 50 and the second bent part 60 may be an arc form, and the first fin part 30 and the second fin part 40 may be a straight line form.

The number, form or arrangement of the condensate water discharge fins 571 and 572 formed in the bent parts may be disposed in the form of at least any one of the first to fifth embodiments.

The number, form and arrangement of the condensate water discharge holes formed in the bent parts may be disposed in the form of at least any one of the first to fifth embodiments.

Hereinafter, the remaining configuration is the same as that of the second embodiment, and a detailed description thereof is omitted.

Figure 16:
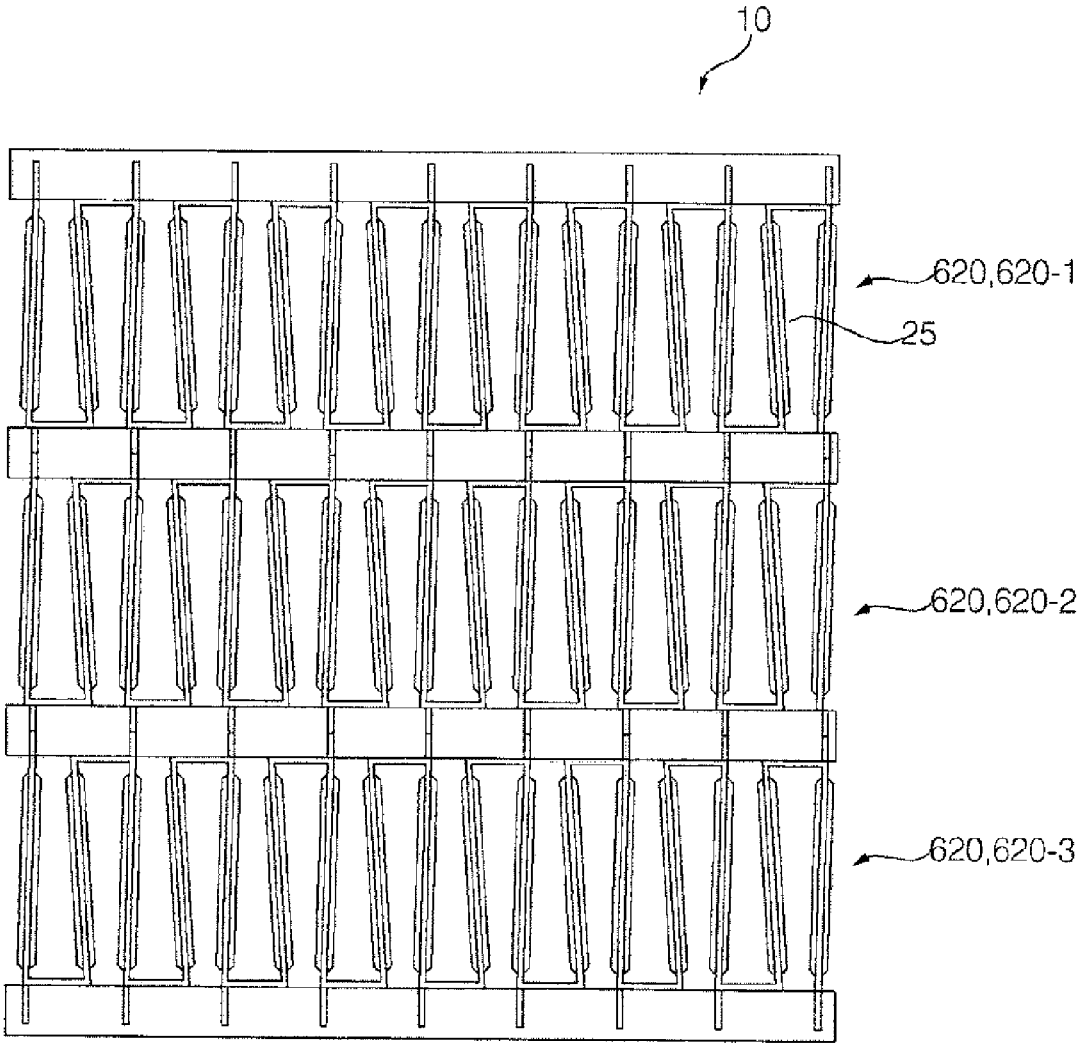
FIG. 16 is a perspective view of a micro channel type heat exchanger according to a seventh embodiment of the present invention.

A micro channel type heat exchanger according to a seventh embodiment of the present invention is described with reference to FIG. 16.

In the present embodiment, for a description, a fin 620 located at the top is defined as a first fin 620-1, a fin 620 located under the first fin 620-1 is defined as a second fin 620-2, and a fin 620 located under the second fin 620-2 is defined as a third fin 620-3.

The fin 620 according to the present embodiment has a wave form different from the shape of the second embodiment.

In the second embodiment, a unit wave formed by the first fin part 30, the first bent part 50, the second fin part 40 and the second bent part 60 has a square. In contrast, the unit wave of the present embodiment is formed in a trapezoid form.

The first fin part 30 and the second fin part 40 may be disposed slantly with respect to a vertical direction. The slope direction of the first fin part 30 and the slope direction of the second fin part 40 may be different. The slope direction of the first fin part 30 and the slope direction of the second fin part 40 may be symmetrical.

Meanwhile, the fins 620 may be symmetrically disposed in the up and down direction.

For example, the first fin 620-1 and the second fin 620-2 may be symmetrically disposed with respect to the up and down direction, and the unit wave may also be symmetrically disposed with respect to the up and down direction. Furthermore, the second fin 620-2 and the third fin 620-3 may be symmetrically disposed with respect to the up and down direction, and the unit wave may also be symmetrically disposed with respect to the up and down direction.

The number, form or arrangement of the condensate water discharge fins formed in the bent parts may be disposed in the form of at least any one of the first to fifth embodiments.

The number, form and arrangement of the condensate water discharge holes formed in the bent parts may be disposed in the form of at least any one of the first to fifth embodiments.

Hereinafter, the remaining configuration is the same as that of the second embodiment, and a detailed description thereof is omitted.

Figure 17:
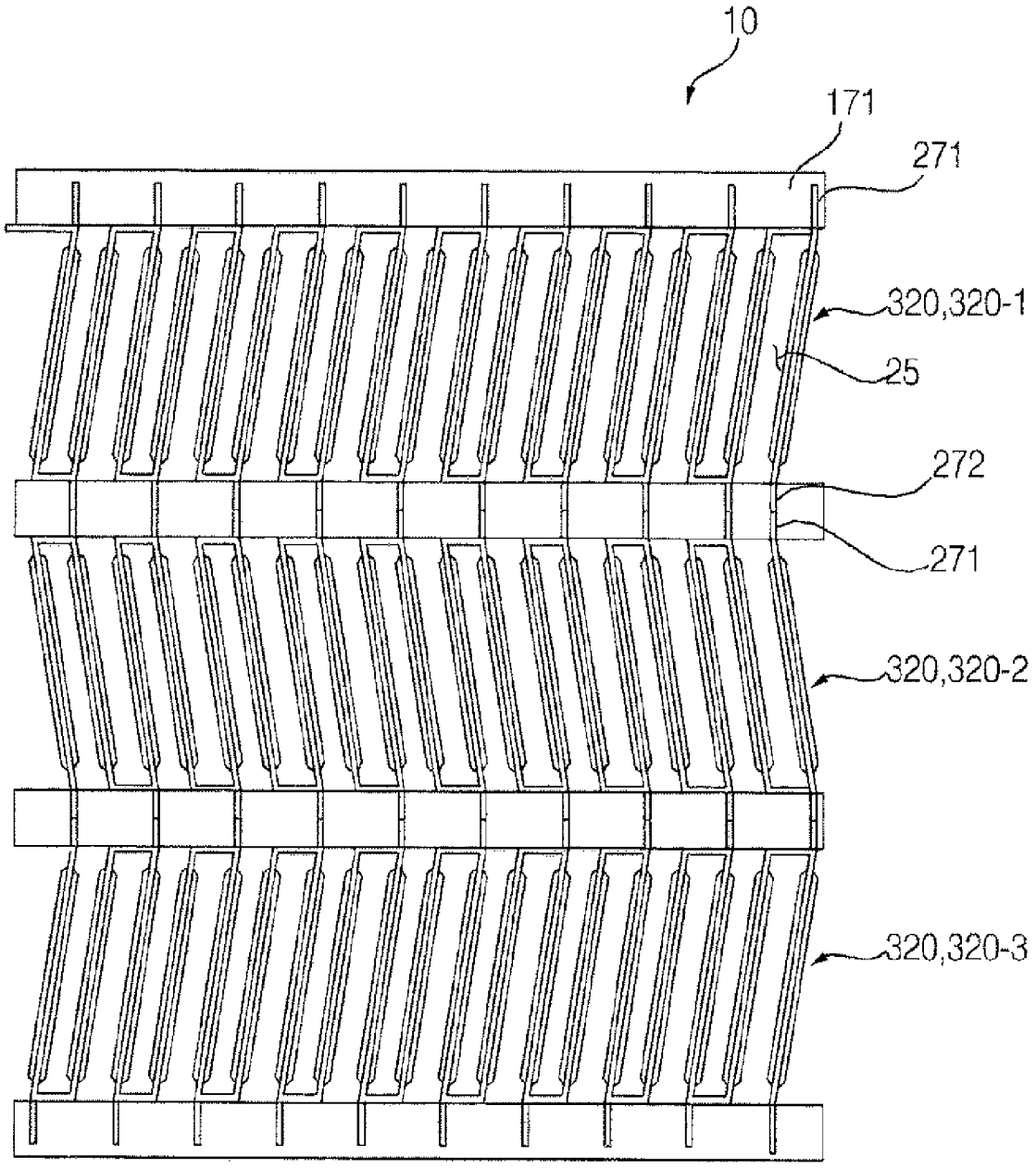
FIG. 17 is a perspective view of a micro channel type heat exchanger according to an eighth embodiment of the present invention.

A micro channel type heat exchanger according to an eighth embodiment of the present invention is described with reference to FIG. 17.

In the present embodiment, for a description, a fin 720 located at the top is defined as a first fin 720-1, a fin 720 located under the first fin 720-1 is defined as a second fin 720-2, and fin 720 located under the second fin 720-2 is defined as a third fin 720-3.

The fin 720 according to the present embodiment has a wave form different from the shape of the second embodiment.

In the second embodiment, a unit wave formed by the first fin part 30, the first bent part 50, the second fin part 40 and the second bent part 60 forms a square. In contrast, the unit wave of the present embodiment is formed in a parallelogram form.

The first fin part 30 and the second fin part 40 may be disposed slantly with respect to a vertical direction. The slope direction of the first fin part 30 and the slope direction of the second fin part 40 may be formed in the same direction.

Meanwhile, the fins 720 may be symmetrically disposed in the up and down direction.

For example, the first fin 620-1 and the second fin 620-2 may be symmetrically disposed with respect to the up and down direction, and the unit wave may also be symmetrically disposed with respect to the up and down direction. Furthermore, the second fin 620-2 and the third fin 620-3 may be symmetrically disposed with respect to the up and down direction, and the unit wave may also be symmetrically disposed with respect to the up and down direction.

The number, form or arrangement of the condensate water discharge fins formed in the bent parts may be disposed in the form of at least any one of the first to fifth embodiments.

The number, form and arrangement of the condensate water discharge holes formed in the bent parts may be disposed in the form of at least any one of the first to fifth embodiments.

Hereinafter, the remaining configuration is the same as that of the second embodiment, and a detailed description thereof is omitted.

Figure 18:
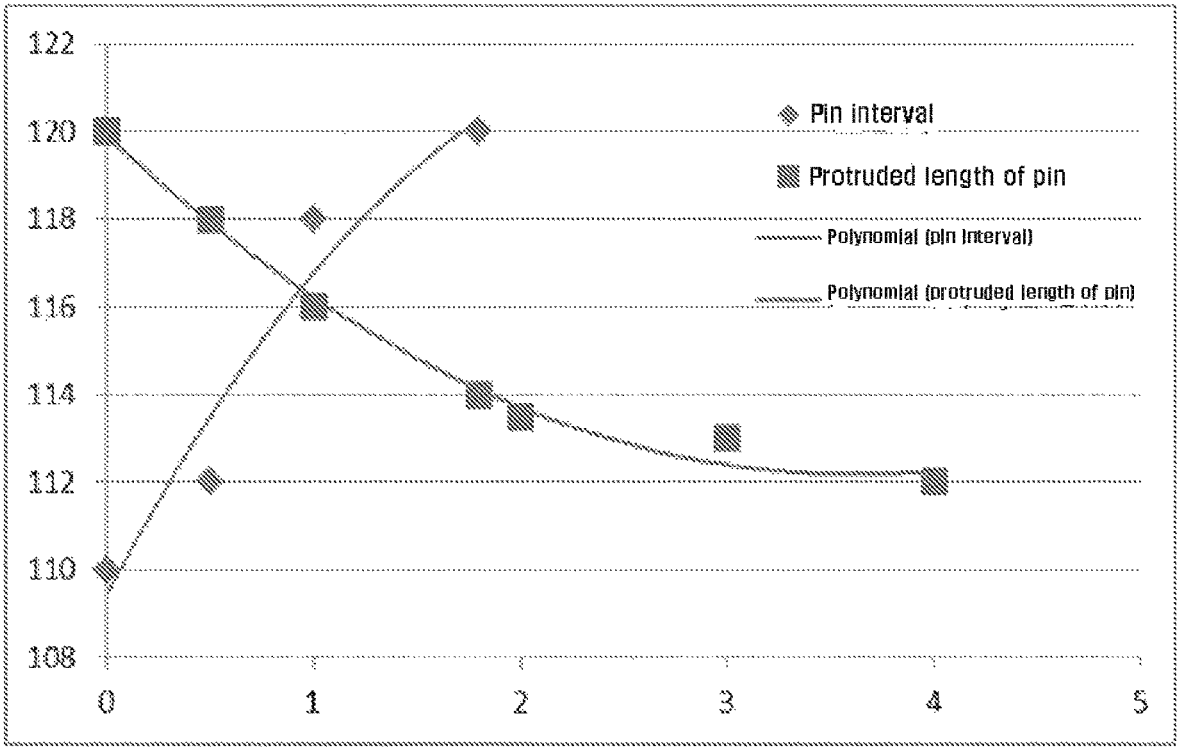
FIG. 18 is a graph showing a change of Wet/Dry ΔP according to the interval between condensate water discharge fins and the protruded length of the condensate water discharge fin according to a third embodiment of the present invention.
Figure 19:
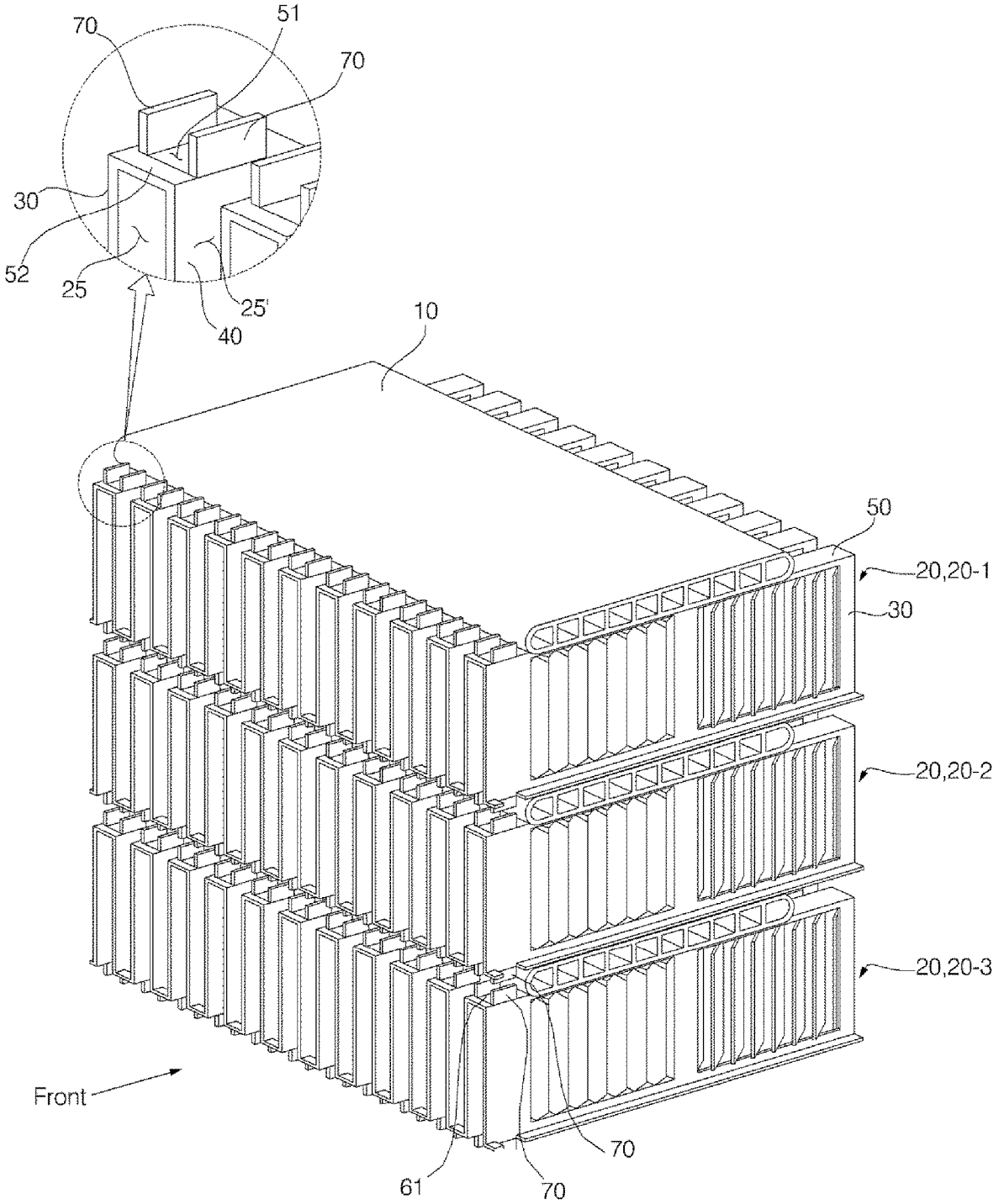
FIG. 19 is a perspective view of a micro channel type heat exchanger according to a ninth embodiment of the present invention.
Figure 20:
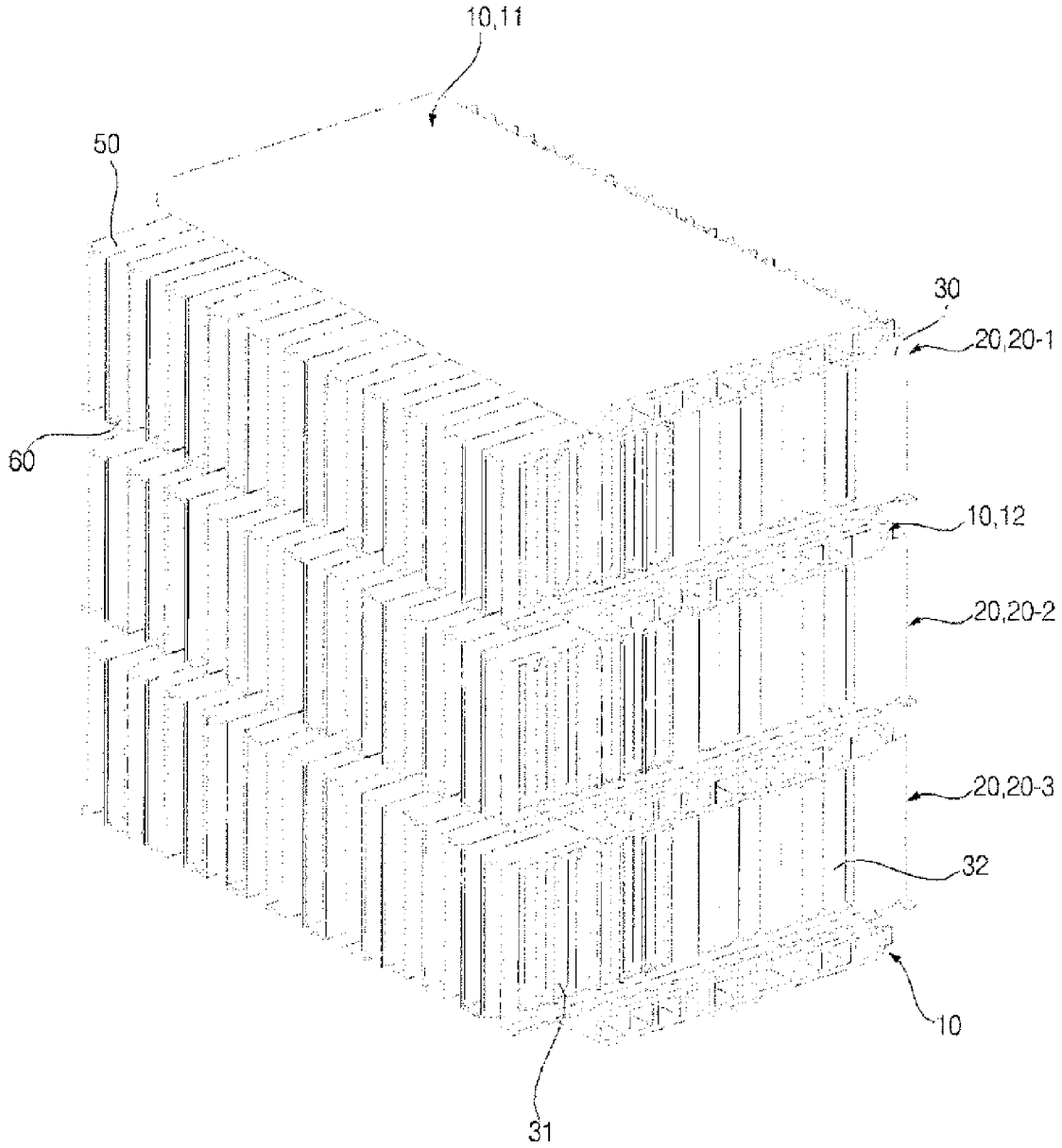
FIG. 20 is a rear-side perspective view of FIG. 19.
Figure 21:
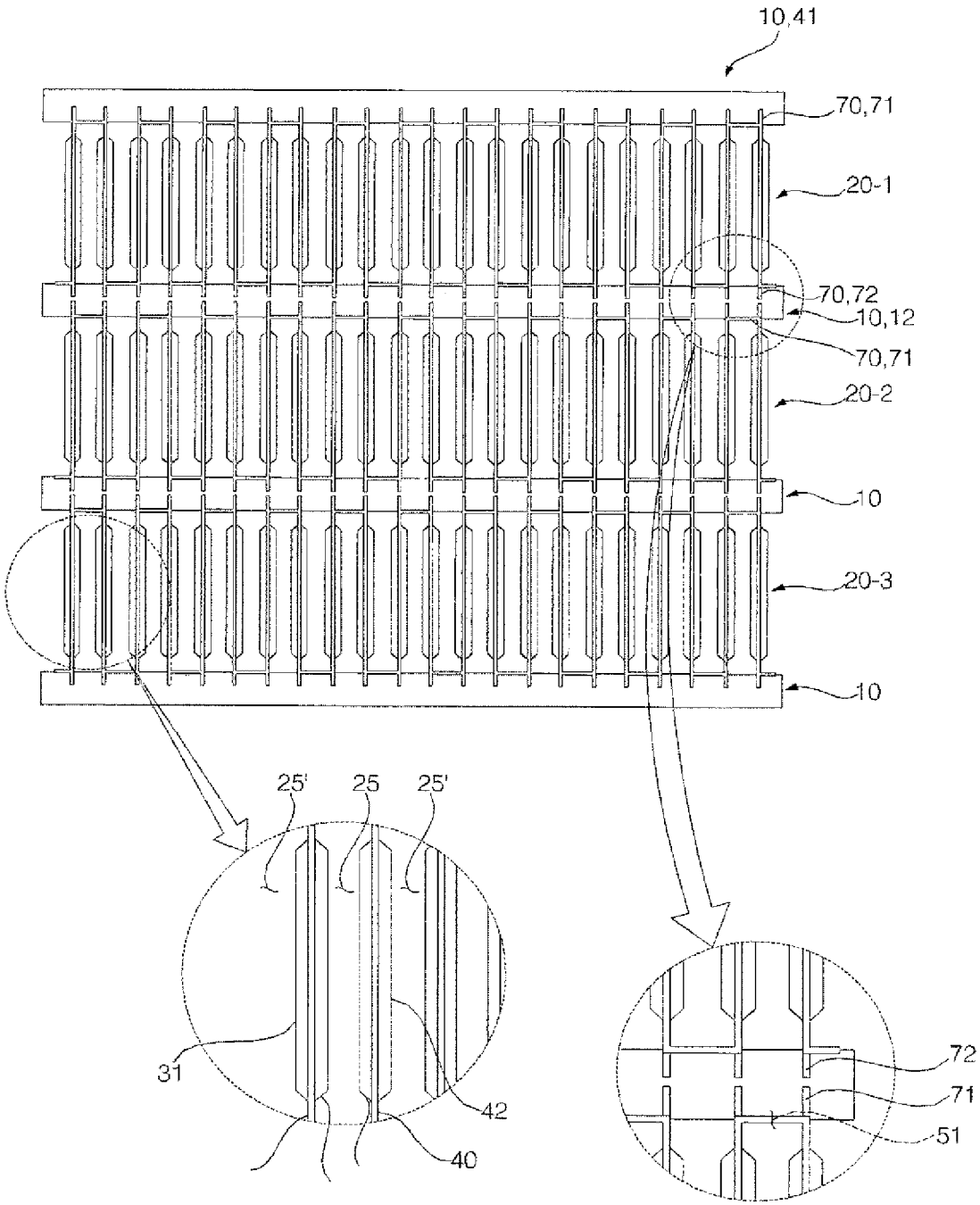
FIG. 21 is a front view of FIG. 19.
Figure 22:
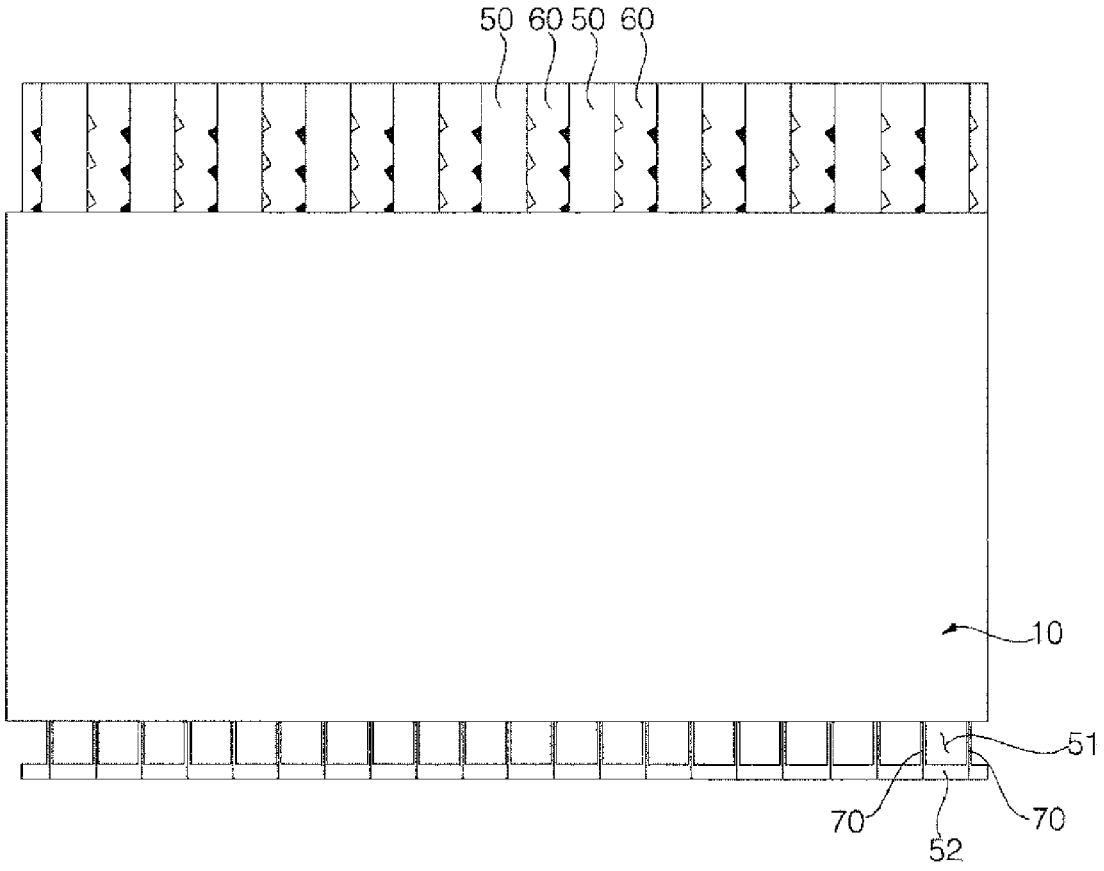
FIG. 22 is a plane view of FIG. 19.
Figure 23:
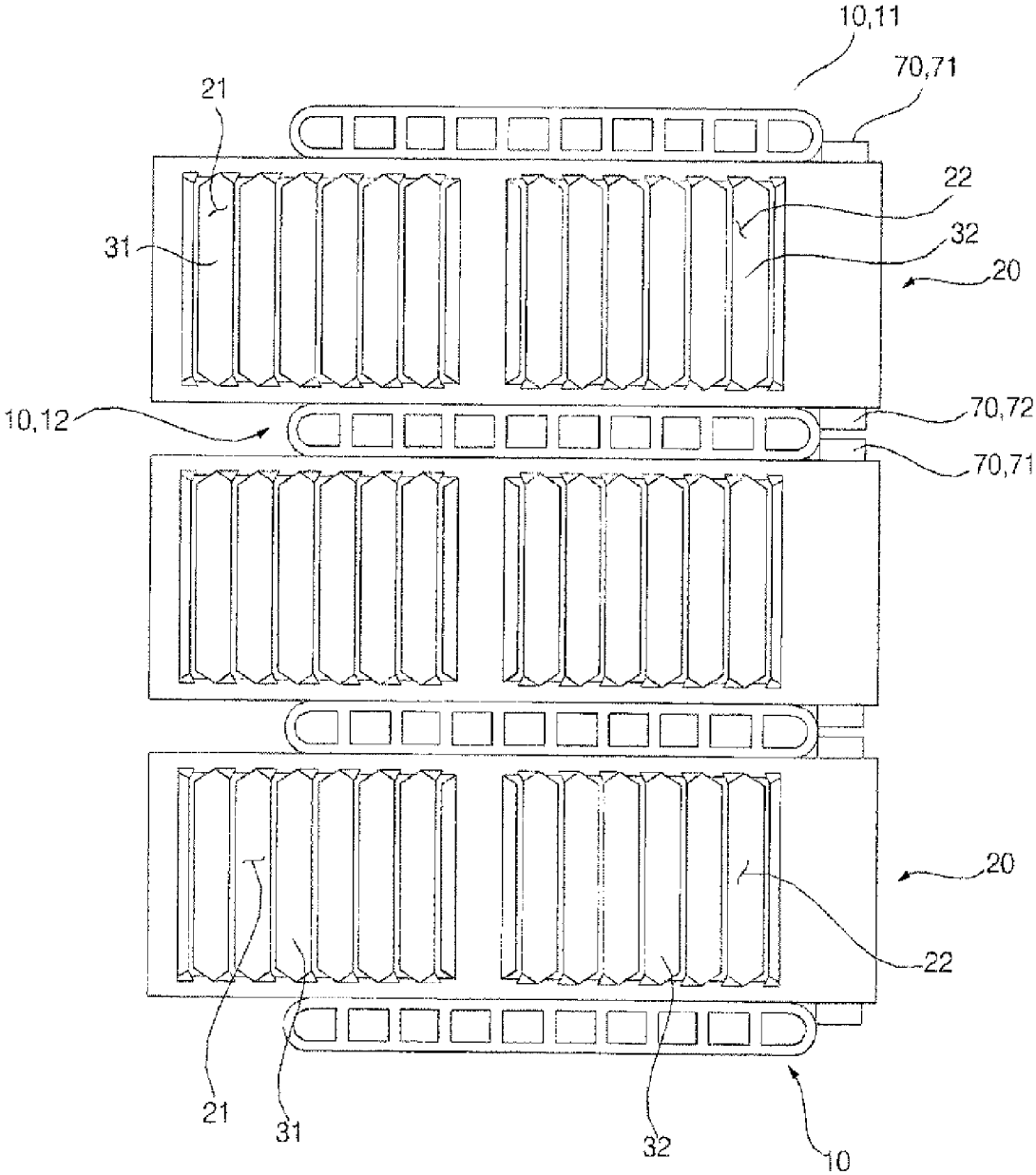
FIG. 23 is a left side view of FIG. 19.
Figure 24:
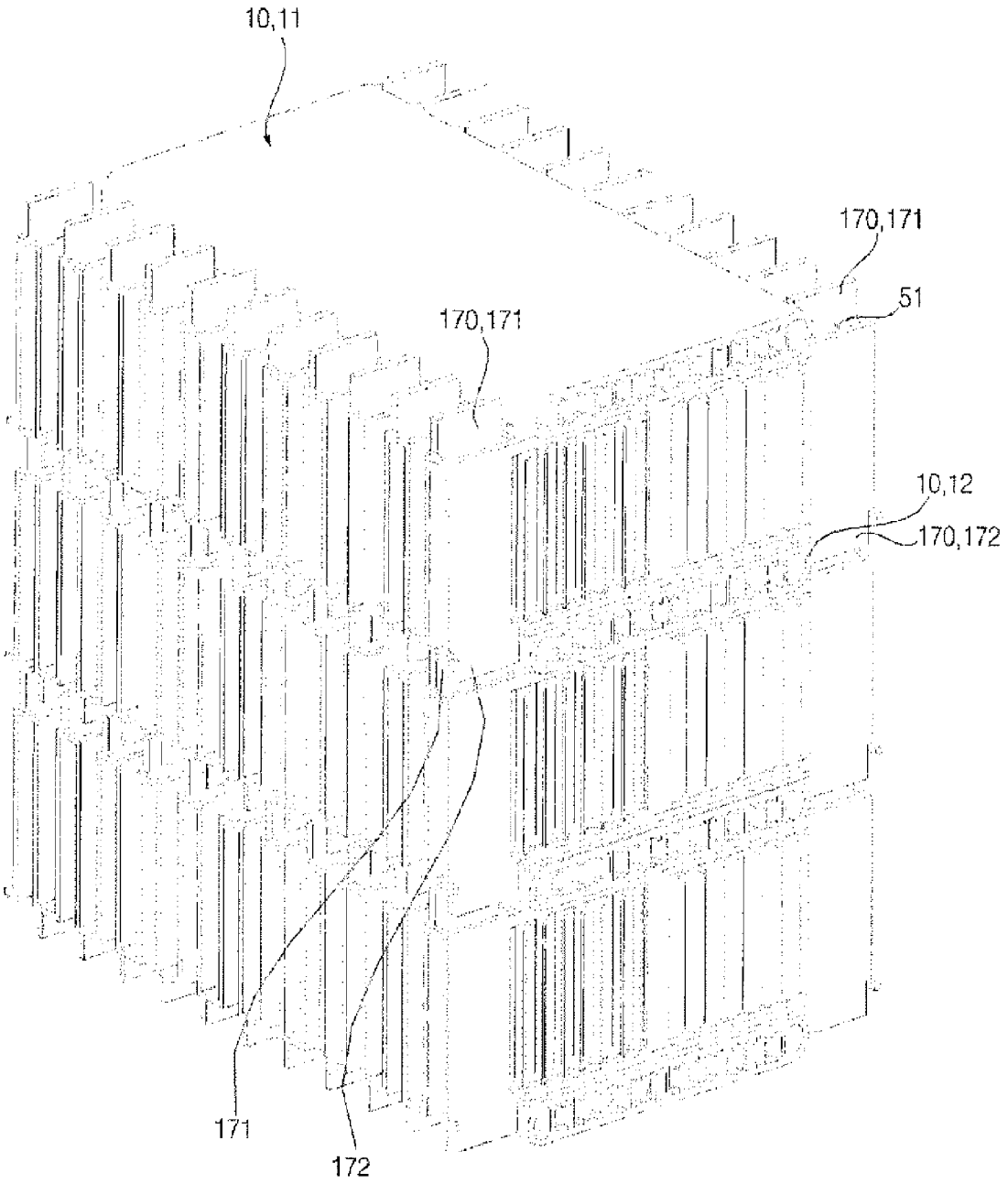
FIG. 24 is a perspective view of a micro channel type heat exchanger according to a tenth embodiment of the present invention.
Figure 25:
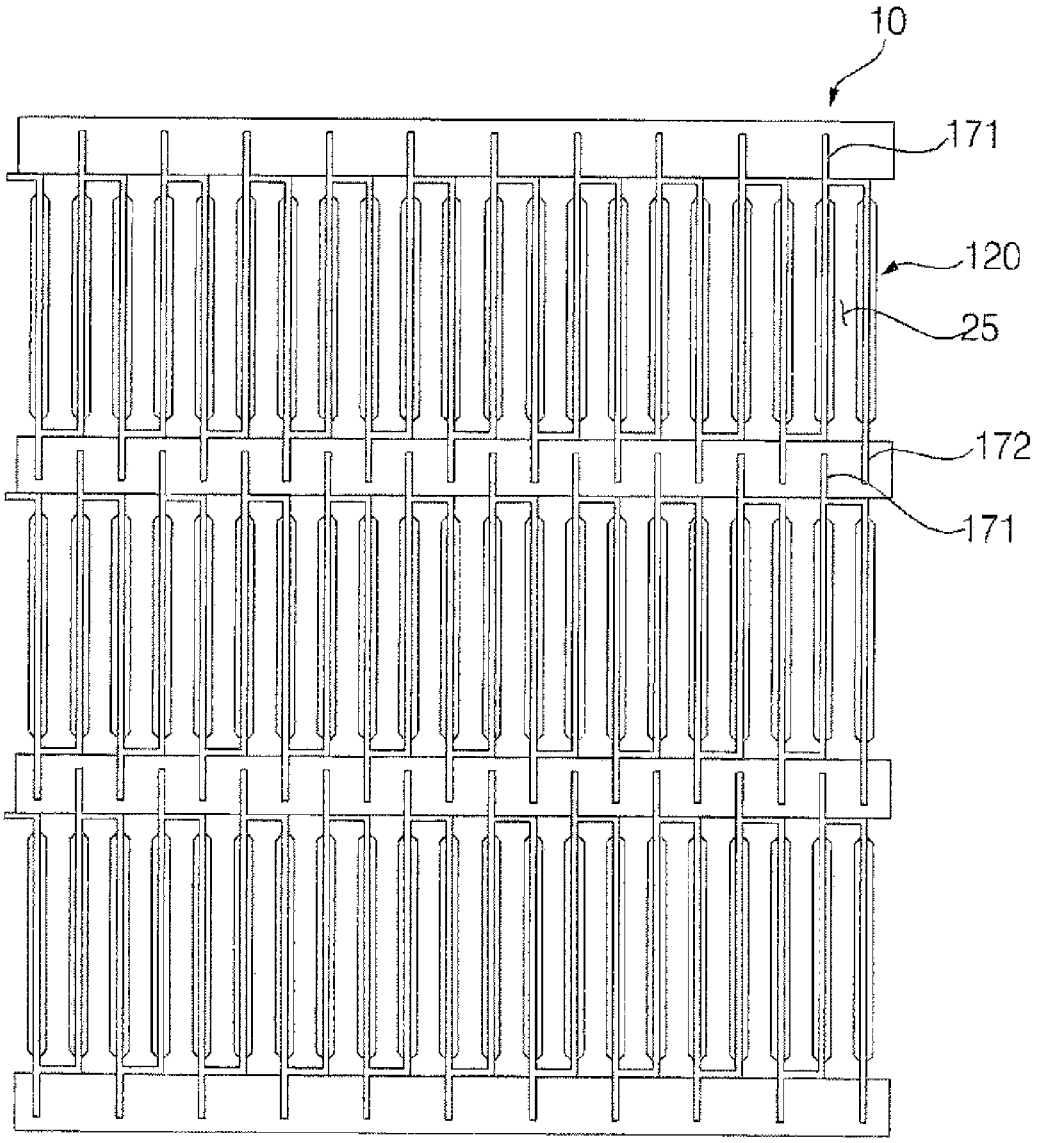
FIG. 25 is a front view of FIG. 24.
Figure 26:
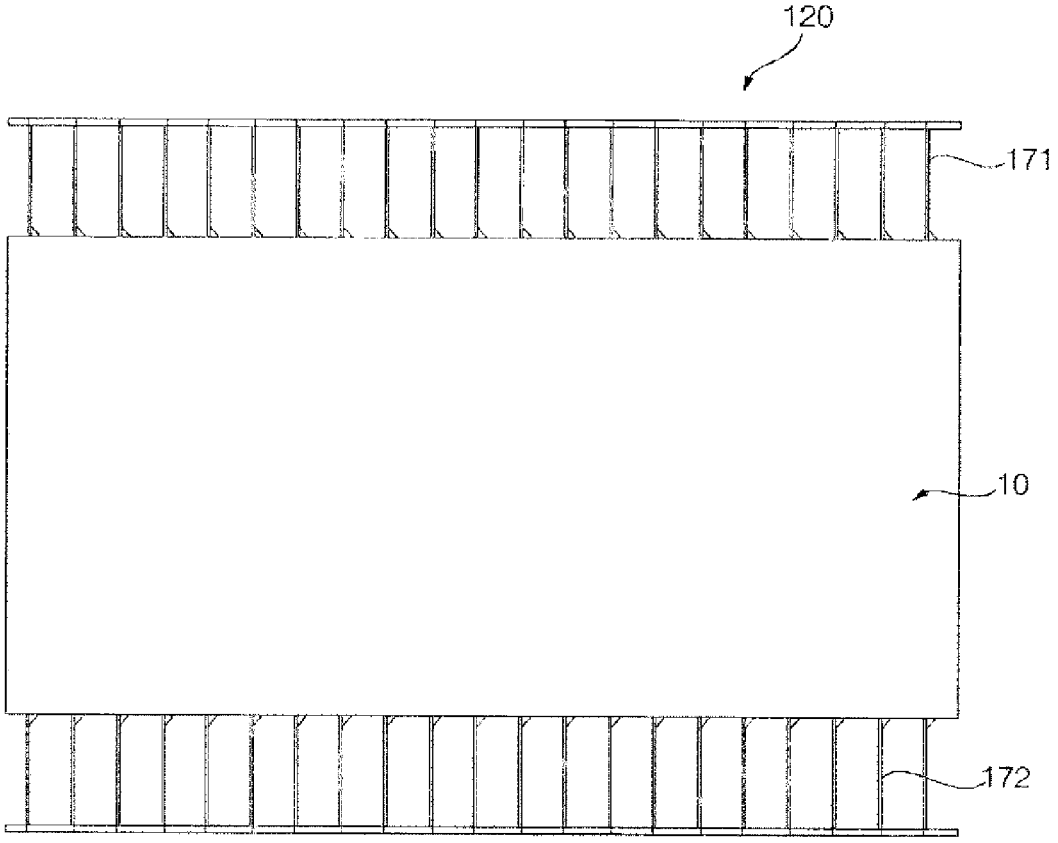
FIG. 26 is a plane view of FIG. 24.
Figure 27:
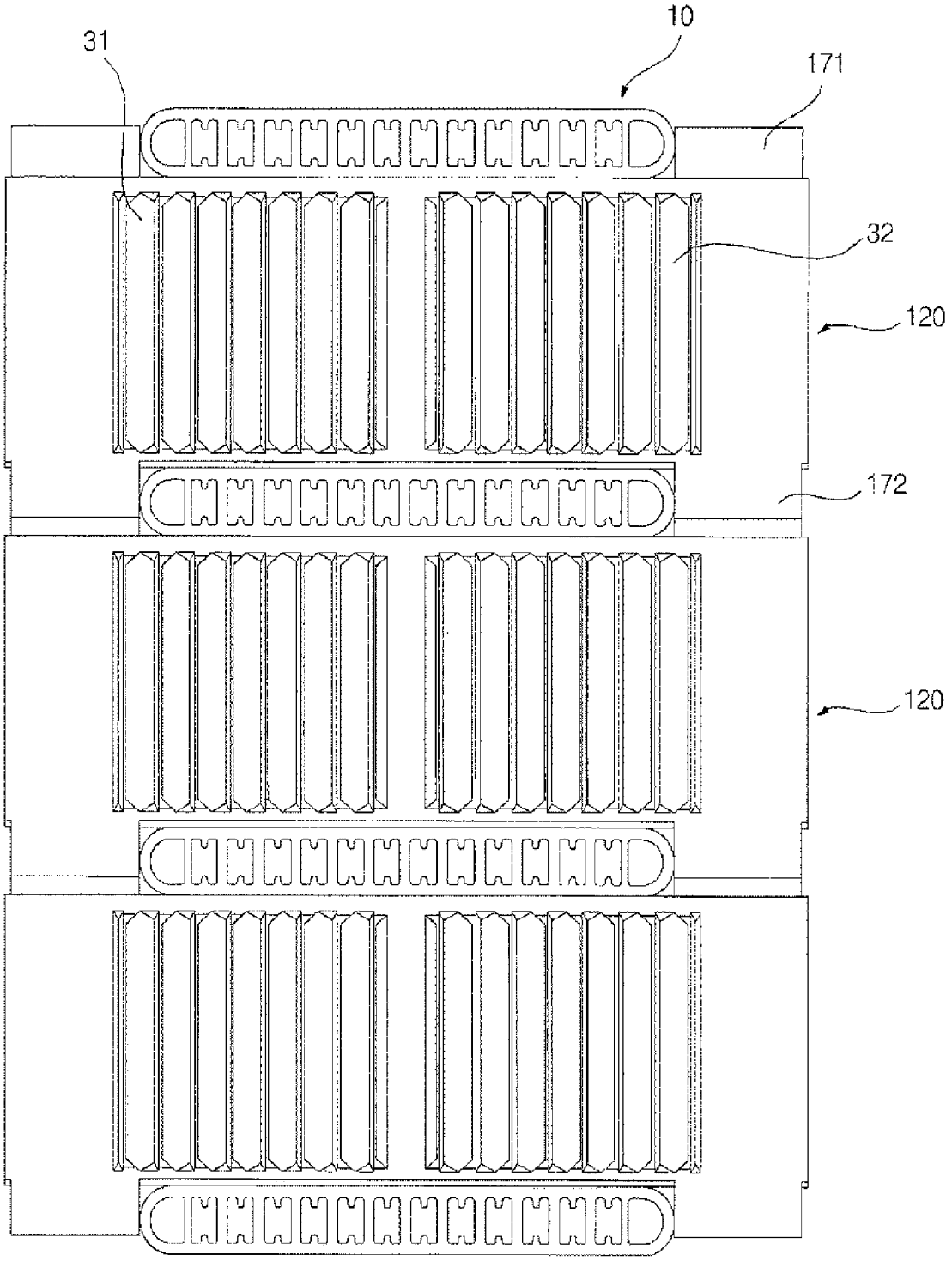
FIG. 27 is a right side view of FIG. 24.

FIG. 18 is a graph showing a change of Wet/Dry ΔP according to the interval between condensate water discharge fins and the protruded length of the condensate water discharge fin according to a third embodiment of the present invention.

The interval between the condensate water discharge fins means the interval between the first condensate water discharge fin of a second fin and the second condensate water discharge fin of a first fin.

The protruded length of the condensate water discharge fin means a length in which the condensate water discharge fin is protruded from the edge of the flat tube to the outside. In the present embodiment, the protruded length is a length in which the condensate water discharge fin is protruded from the edge of the flat tube to the front side or the rear side.

Referring to the graph, the distance between the condensate water discharge fins is preferably is 0 mm or more to 0.5 mm or less. The protruded length of the condensate water discharge fin is preferably is 2 mm or more to 4 mm or less.

A micro channel heat exchanger according to a ninth embodiment is described with reference to FIGS. 19 to 23.

Unlike in the first embodiment, in the micro channel type heat exchanger according to the present embodiment, a first condensate water discharge fin 71 and a second condensate water discharge fin 72 are spaced apart and disposed.

The micro channel type heat exchanger according to the present embodiment includes a plurality of flat tubes 10 in which a plurality of flow channels has been formed therein, a fin 20 disposed between the two flat tubes 10 and coupled to two flat tubes 10 to conduct heat, and a first header (not shown) and a second header (not shown) assembled with both ends of the plurality of flat tubes 10 to move a refrigerant.

In the micro channel type heat exchange, if a refrigerant is supplied to the first header, the refrigerant passes through the flat tubes 10 and moves to the second header. In contrast, if a refrigerant is supplied to the second header, the refrigerant flows to the first header.

The first header and the second header are structures widely known to those skilled in the art, and a detailed description thereof is omitted.

The flat tube 10 is formed in a flat shape and has a plurality of flow channels formed therein. The flat tube 10 is formed using a metal material. In the present embodiment, the flat tube is made of an aluminum material.

In the present embodiment, the flat tube 10 is horizontally disposed, and the extension direction of the fins 20 is also horizontally disposed. The micro channel type heat exchanger according to the present embodiment has a structure in which the flat tubes 10 and the fins 20 are horizontally disposed to facilitate the discharge of condensate water.

Unlike in the present embodiment, the extension direction of the flat tube 10 and the fin 20 may be vertically disposed.

The fin 20 is bent in the length direction of the flat tube 10. Since the fins 20 can be fabricated by a consecutive process according to a fin roll method, there is an advantage in that a fabrication cost is low.

The fin 20 is made of a metal material. In the present embodiment, the fin 20 is fabricated using the same aluminum as the flat tube 10. The fin 20 is for improving heat exchange efficiency by rapidly conducting heat of the flat tube 10.

The fin 20 is disposed between the flat tubes 10. For a description, a fin 20 located at the top is defined as a first fin 20-1, a fin 20 located under the first fin 20-1 is defined as a second fin 20-2, and a fin 20 located under the second fin 20-2 is defined as a third fin 20-3.

The fin 20 includes a first fin part 30 disposed between two flat tubes 10, a first bent part 50 bent from the first fin part 30 and coming into contact with any one of the two flat tubes 10, a second fin part 40 bent from the first bent part 50, facing the first fin part 30, and disposed between the two flat tubes 10, and a second bent part 60 bent from the second fin part 40 and coming into contact with the other of the two flat tubes 10.

For convenience of description, a flat tube 10 coming into contact with the first bent part 50 is defined as a first flat tube 11, and a flat tube 10 coming into contact with the second bent part 60 is defined as a second flat tube 12.

In the fin 20, the first fin part 30, the first bent part 50, the second fin part 40 and the second bent part 60 are repeatedly formed.

The first fin part 30 supports the first flat tube 11 and the second flat tube 12.

The first fin part 30 is orthogonally disposed with respect to the length direction of the first flat tube 11 and the second flat tube 12.

Like the first fin part 30, the second fin part 40 also supports the first flat tube 11 and the second flat tube 12 and is orthogonally disposed with respect to the length direction of the first flat tube 11 and the second flat tube 12.

The first fin part 30 and the second fin part 40 are spaced apart at a specific distance. A flow space 25 in which air flows is formed between the first fin part 30 and the second fin part 40.

Air for heat exchange passes through the flow space 25 formed between the first fin part 30 and the second fin part 40.

As the interval between the flow spaces 25 formed between the first fin part 30 and the second fin part 40 is narrow, more fin parts can be installed, and thus heat exchange efficiency can be improved.

In this case, if the interval between the flow spaces 25 is narrow, condensate water generated when the heat exchanger operates as an evaporator may be attached and fixed to the first fin part 30 and the second fin part 40 by surface tension. In the present embodiment, the interval is formed so that condensate water does not connect the first fin part 30 and the second fin part 40 by surface tension.

Condensate water generated in the first fin part 30 and the second fin part 40 runs downward because it comes into contact with air that flows along the flow space 25.

Vents 21 and 22 communicating with a neighbor flow space 25' are formed in at least any one of the first fin part 30 or the second fin part 40.

In the present embodiment, the vents 21 and 22 are formed in both the first fin part 30 and the second fin part 40. Furthermore, the two vents 21 and 22 are formed in the first fin part 30 and the second fin part 40. Unlike in the present embodiment, only one vent may be formed in the first fin part 30 and the second fin part 40.

For convenience of description, the vents 21 and 22 are defined as a first vent 21 and a second vent 22.

The vent 21, 22 is formed in a hole or slit form.

In the present embodiment, the vents 21 and 22 are formed by cutting off the first fin part 30 and the second fin part 40.

A (1-1)-th louver 31 forming the first vent 21 is formed in the first fin part 30. Furthermore, a (1-2)-th louver 32 forming the second vent 22 is formed in the first fin part 30.

The cut first fin part 30 is bent to form the (1-1)-th louver 31. The first vent 21 is formed at the position where the (1-1)-th louver 31 is cut off.

The (1-2)-th louver 32 is also formed using the same method as the (1-1)-th louver 31.

The louvers 31 and 32 function to guide some of air flowing along the flow space 25 to a neighboring flow space 25'.

In the present embodiment, the (1-1)-th louver 31 and the (1-2)-th louver 32 are formed to guide air in different directions.

For example, if the (1-1)-th louver 31 is formed to guide air from the neighbor flow space 25' to the flow space 25, the (1-2)-th louver 32 is formed to guide air from the flow space 25 to the neighbor flow space 25'.

The louver is protruded from the first fin part 30 or the second fin part 40 to the flow space 25 or the neighbor flow space 25'.

The louver is formed vertically with respect to the length direction of the first flat tube 11 and the second flat tube 12.

A louver formed in the second fin part 40 has the same structure as a louver formed in the first fin part 30. For convenience of description, the louvers are defined as a (2-1)-th louver 41 and a (2-2)-th louver 42.

The first vent 21 is formed in the second fin part 40 by the (2-1)-th louver 41, and the second vent 22 is formed in the second fin part 40 by the (2-2)-th louver 42.

Since the (1-1)-th louver 31 and the (1-2)-th louver 32 are formed in opposite directions, the direction in which the fin 20 is disposed may not be considered when the heat exchanger is installed.

The first bent part 50 is closely attached to the first flat tube 11 and conducts heat of the first flat tube 11.

In the present embodiment, the first bent part 50 is formed as a plane.

In the present embodiment, the first bent part 50 is disposed on the upper side and the second bent part 60 is disposed on the lower side, but the second bent part 60 may be disposed on the upper side and the first bent part 50 may be disposed on the lower side.

Condensate water discharge fins 70 and 71 for discharging condensate water of the flow space 25 are formed in the first bent part 50.

The condensate water discharge fin 70 is cut off from the first bent part 50 and then bent.

Accordingly, a condensate water discharge hole 51 is formed at the position where the condensate water discharge fin 70 was located in the first bent part 50. A condensate water discharge hole formed in the first bent part 50 is defined as the first condensate water discharge hole 51.

In the present embodiment, two condensate water discharge fins 70 are formed in the first bent part 50 in such a way as to face each other. Only one condensate water discharge hole 51 is formed.

Since two condensate water discharge fins 70 are formed in a limited area, the condensate water discharge fin 70 is fabricated to have a length that is half or less of the width of the first bent part 50.

Furthermore, a connection part 52 connecting the first fin part 30 and the second fin part 40 is formed at the edge of the first bent part 50.

The connection part 52 is a portion left over when the condensate water discharge fin 70 is formed. Accordingly, the connection part 52 is formed to come into contact with the condensate water discharge hole 51. The connection part 52 improves strength of the fin 20 because it connects the first fin part 30 and the second fin part 40.

Condensate water located in the flow space 25 can be discharged to the outside of the flow space 25 through the condensate water discharge hole 51.

The condensate water discharge fin 70 guides a flow of condensate water when the condensate water is discharged.

The condensate water discharge hole 61 and the condensate water discharge fins 70 and 72 having the same structure as the first bent part 50 are also formed in the second bent part 60. A condensate water discharge hole formed in the second bent part 60 is defined as the second condensate water discharge hole 61.

Since the flat tubes 10 are stacked and the fin 20 is disposed between the flat tubes 10, the condensate water discharge fin 71 formed in the first bent part 50 and the condensate water discharge fin 72 formed in the second bent part 60 are disposed up and down.

For convenience of description, a condensate water discharge fin disposed in the first bent part 50 is defined as the first condensate water discharge fin 71, and a condensate water discharge fin disposed in the second bent part 60 is defined as the second condensate water discharge fin 72.

The first condensate water discharge fin 71 and the second condensate water discharge fin 72 may be disposed up and down. The first condensate water discharge fin 71 and the second condensate water discharge fin 72 may be arranged in a row. If the first condensate water discharge fin 71 and the second condensate water discharge fin 72 are arranged in a row, the first condensate water discharge fin 71 and the second condensate water discharge fin 72 may be spaced apart at a specific interval.

The interval between the first condensate water discharge fin 71 and the second condensate water discharge fin 72 is a distance in which they can be moved by surface tension of condensate water.

Accordingly, condensate water generated from the flow space 25 of the fin 20 on the upper side may be discharged to the condensate water discharge hole 61 and may move along the second condensate water discharge fin 72. Furthermore, the condensate water may flow downward along an adjacent second condensate water discharge fin 72 and first condensate water discharge fin 71.

The flat tube 10 may be closely attached and disposed in the condensate water discharge fin 70. When the heat exchanger is used as an evaporator, the flat tube 10 has the lowest temperature. Condensate water generated from the flat tube 10 can rapidly move downward through the closely attached condensate water discharge fin 70. When condensate water rapidly flows as described above, the freezing of the condensate water on a surface of the flat tube 10 can be minimized.

In the present embodiment, the condensate water discharge fin 70 and the condensate water discharge holes 51 and 61 are formed only on one side of the fin 20. Unlike in the present embodiment, the condensate water discharge fin 70 and the condensate water discharge holes 51 and 61 may be formed on both sides of the fin 20.

Furthermore, in the present embodiment, the condensate water discharge fin 70 and the condensate water discharge holes 51 and 61 are formed by cutting off the first bent part 50 and the second bent part 60. Unlike in the present embodiment, only the condensate water discharge holes 51 and 61 may be formed. Furthermore, if the condensate water discharge holes 51 and 61 are formed, a plurality of the condensate water discharge holes 51 and 61 may be formed along the first bent part 50 or the second bent part 60.

A micro channel type heat exchanger according to a tenth embodiment of the present invention is described with reference to FIGS. 24 to 27.

In the heat exchanger according to the present embodiment, the location and arrangement structure of the condensate water discharge fin 70 are different from those of the first embodiment.

In the fin 120 according to the present embodiment, condensate water discharge fins 170 are formed at the edges of the first bent part 50 on both sides, respectively. In the fin 120, the condensate water discharge fins 170 are formed at the edges of the second bent part 60 on both sides, respectively.

For convenience of description, a condensate water discharge fin disposed in the first bent part 50 is defined as a first condensate water discharge fin 171, and a condensate water discharge fin disposed in the second bent part 60 is defined as a second condensate water discharge fin 172.

The condensate water discharge holes 51 are formed at the edges of the first bent part 50 on both sides.

The condensate water discharge holes 61 are formed at the edges of the second bent part 60 on both sides.

Unlike in the first embodiment, a single condensate water discharge fin 170 may be formed in a single condensate water discharge hole 51, 61.

The first condensate water discharge fins 171 and the second condensate water discharge fins 172 formed in the fin 120 are disposed up and down in such a way as to go across. That is, unlike in the first embodiment, the first condensate water discharge fins 171 and the second condensate water discharge fins 172 are not disposed in a row.

Accordingly, if the fins 120 are stacked, the first condensate water discharge fins 171 and the second condensate water discharge fins 172 are located left and right in such a way as to go across. Specifically, the first condensate water discharge fins 171 and the second condensate water discharge fins 172 are disposed to go across in such a way as to face each other.

In the state in which the fins 120 have been stacked, the second condensate water discharge fins 172 of the fin 120 in the upper floor are located to face the first condensate water discharge fins 171 of the fin 120 in the lower floor.

In the present embodiment, when the fin 120 is viewed from the front, the first condensate water discharge fins 171 and the second condensate water discharge fins 172 are disposed in a row with.

Unlike in the present embodiment, when the fin 120 is viewed from the front, the first condensate water discharge fins 171 may be disposed to go across. The second condensate water discharge fins 172 may also be disposed to go across when they are viewed from the front.

Hereinafter, the remaining configuration is the same as that of the first embodiment, and a detailed description thereof is omitted.

Although the embodiments of the present invention have been described with reference to the accompanying drawings, the present invention is not limited to the embodiments and may be fabricated in different various forms. A person having ordinary skill in the art to which the present invention pertains may understand that the present invention may be practiced in other detailed forms without changing the technical spirit or essential characteristics of the present invention. Accordingly, the aforementioned embodiments should be understood to be illustrative from all aspects, but to be not limiting.

The invention claimed is:

1. A micro channel type heat exchanger comprising at least one flat tube that extends horizontally; a first fin disposed over the flat tube to conduct heat of the flat tube; and a second fin disposed under the flat tube to conduct heat of the flat tube, wherein:

the first fin comprises:

a plurality of first fin parts disposed on the flat tube, disposed to cross the flat tube and having a first end and a second end;

a plurality of second fin parts disposed on the flat tube, disposed to cross the flat tube between the plurality of the first fin parts, and having a first end and a second end;

a plurality of first planar bent parts bent from the first end of each of the plurality of first fin parts and each of the plurality of second fin parts to connect upper parts of the first ends of the plurality of first fin parts and the first ends of the plurality of second fin parts;

a plurality of second bent parts bent from the second end of each of the plurality of first fin parts and the second end of each of the plurality of second fin parts to connect lower parts of the second-side end of the plurality of first fin parts and the second ends of the plurality of second fin parts;

flow spaces formed between the plurality of first fin parts and the plurality of second fin parts;

a plurality of first condensate water discharge fins formed at an outer edge of each of the plurality of first bent parts by cutting a portion of each of the plurality of first bend parts at a boundary between the plurality of second fin parts and the plurality of first bent parts and bending the portion upward away from the boundary to form a condensate water discharge hole; and a plurality of second condensate water discharge fins formed at an outer edge of each of the plurality of second bent parts by cutting a portion of each of the plurality of second bend parts at a boundary between the plurality of second fin parts and the plurality of second bent parts and bending the portion downward away from the boundary to form a condensate water discharge hole, and the second fin comprises:

a plurality of the first fin parts disposed under the flat tube, disposed to cross the flat tube and having a first end and a second end;

a plurality of second fin parts disposed under the flat tube, disposed to cross the flat tube between the plurality of the first fin parts, and having a first end and a second end;

a plurality of first planar bent parts bent from the first end of each of the plurality of first fin parts and the first end of each of the plurality of second fin parts to connect the first ends of the plurality of first fin parts and the first ends of the plurality of second fin parts;

a plurality of second planar bent parts bent from the second end of each of the plurality of first fin parts and the second end of each of the plurality of second fin parts to connect the second ends of the plurality of first fin parts and the second ends of the plurality of second fin parts;

flow spaces formed between the plurality of first fin parts and the plurality of second fin parts;

a plurality of first condensate water discharge fins formed at an outer edge of the plurality of first bent parts by cutting a portion of each of the plurality of first bend parts at a boundary between the plurality of second fin parts and the plurality of first bent parts and bending the portion upward away from the boundary to form a condensate water discharge hole; and a plurality of second condensate water discharge fins formed at an outer edge of each of the fin second bent parts by cutting a portion of each of the fin first bend parts at a boundary between the plurality of second fin parts and the plurality of second bent parts and bending the portion downward away from the boundary to form a condensate water discharge hole, wherein a bottom of the second condensate water discharge fins of the first fin are in contact with a top of the first condensate water discharge fins of the second fin, and wherein the flat tube is disposed within a height of the second condensate water discharge fins of the first fin and the first condensate water discharge fins of the second fin.

2. The heat exchanger of claim 1, wherein the first condensate water discharge fins and the second condensate water discharge fins are disposed at an outside of the flat tube.

3. The heat exchanger of claim 1, wherein the first fin comprises a unit wave comprising the plurality of first fin parts, the plurality of first bent parts, the plurality of second fin parts and the second bent parts, wherein a plurality of the unit waves is formed to extend in a lengthwise direction of the flat tube, and wherein the plurality of unit waves is formed in a wave form.

4. The heat exchanger of claim 1, wherein the first fin comprises a unit wave comprising the plurality of first fin parts, the plurality of first bent parts, the plurality of second fins parts and the plurality of second bent parts, wherein a plurality of the unit waves is formed to extend in a lengthwise direction of the flat tube, and wherein the plurality of unit waves is formed in a trapezoid form.

5. The heat exchanger of claim 4, wherein the plurality of first fin parts and the plurality of second fin parts are slanted with respect to a vertical direction, and wherein a slope direction of the plurality of first fin parts and a slope direction of the plurality of second fin parts extend in opposite directions.

6. The heat exchanger of claim 5, wherein the slope direction of the plurality of first fin parts and the slope direction of the plurality of second fin parts stand face to face with respect to the vertical direction.

7. The heat exchanger of claim 1, wherein the first fin comprises a unit wave comprising the plurality of first fin parts, the plurality of first bent parts, the plurality of second fin parts and the plurality of second bent parts, wherein a plurality of the unit waves is formed to extend in a lengthwise direction of the flat tube, and wherein the plurality of unit waves is formed in a parallelogram form.

* * * * *